US012135031B2

(12) United States Patent
Cho et al.

(10) Patent No.: US 12,135,031 B2
(45) Date of Patent: Nov. 5, 2024

(54) SCROLL COMPRESSOR WITH OIL SUPPLY GROOVE

(71) Applicant: SAMSUNG ELECTRONICS CO., LTD., Suwon-si (KR)

(72) Inventors: Sunghea Cho, Suwon-si (KR); Dohyun Kim, Suwon-si (KR); Jongcheun Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/123,712

(22) Filed: Mar. 20, 2023

(65) Prior Publication Data

US 2023/0287886 A1 Sep. 14, 2023

Related U.S. Application Data

(63) Continuation of application No. PCT/KR2023/002653, filed on Feb. 24, 2023.

(30) Foreign Application Priority Data

Mar. 8, 2022 (KR) ..... 10-2022-0029640

(51) Int. Cl.
*F04C 29/02* (2006.01)
*F04C 18/02* (2006.01)

(52) U.S. Cl.
CPC ..... *F04C 29/02* (2013.01); *F04C 18/0215* (2013.01); *F04C 18/0253* (2013.01);
(Continued)

(58) Field of Classification Search
CPC .. F04C 29/02; F04C 18/0215; F04C 18/0253; F04C 18/0261; F04C 29/023; F04C 29/028
See application file for complete search history.

(56) References Cited

U.S. PATENT DOCUMENTS 6,932,586 B2 * 8/2005 Furusho ..... F04C 29/023 418/55.6
9,133,843 B2 9/2015 Tsuka et al.
(Continued)

FOREIGN PATENT DOCUMENTS

CN 105074221 B 10/2016
JP 2008-2311 1/2008
(Continued)

OTHER PUBLICATIONS

International Search Report dated Jun. 9, 2023 for International Application No. PCT/KR2023/002653.

*Primary Examiner* — Mary A Davis
(74) *Attorney, Agent, or Firm* — STAAS & HALSEY LLP

(57) ABSTRACT

A scroll compressor including a fixed scroll including a wrap accommodation portion having an inner space extending inside the wrap accommodation portion, a thrust surface around the inner space, a fixed wrap in the inner space, and an oil groove on the thrust surface; an orbiting scroll to rotate with respect to the fixed scroll, and including a mirror plate, an orbiting wrap extending from the mirror plate to engage with the fixed wrap, and at least one oil supply groove on the mirror plate facing the thrust surface of the fixed scroll; and a driving motor to rotate the orbiting scroll. When the orbiting scroll rotates, the at least one oil supply groove of the orbiting scroll moves from a first position to receive oil from the oil groove, to a second position to supply the oil to the inner space of the wrap accommodation portion.

14 Claims, 23 Drawing Sheets

(52) U.S. Cl.
CPC ..... *F04C 18/0261* (2013.01); *F04C 29/023* (2013.01); *F04C 29/028* (2013.01)

(56) References Cited

U.S. PATENT DOCUMENTS

| | | | | |
|---|---|---|---|---|
| 10,697,455 | B2 | 6/2020 | Park et al. | |
| 11,022,120 | B2 * | 6/2021 | Nagahara | F04C 29/023 |
| 11,859,617 | B2 * | 1/2024 | Tsuka | F04C 29/02 |
| 2014/0010694 | A1 | 1/2014 | Tsuka et al. | |

FOREIGN PATENT DOCUMENTS

| | | | |
|---|---|---|---|
| JP | 2012-77627 | A | 4/2012 |
| JP | 5691352 | B2 | 4/2015 |
| JP | 2016-223390 | A | 12/2016 |
| KR | 10-2011-0064663 | | 6/2011 |
| KR | 10-2013-0092769 | A | 8/2013 |
| KR | 10-1355114 | | 1/2014 |
| KR | 10-1529415 | B1 | 6/2015 |
| KR | 10-2019-0000171 | | 1/2019 |

* cited by examiner

SCROLL COMPRESSOR WITH OIL SUPPLY GROOVE

CROSS-REFERENCE TO RELATED APPLICATION(S)

This application is a continuation application of International Application No. PCT/KR2023/002653, filed on Feb. 24, 2023, which claims priority to Korean Patent Application No. 10-2022-0029640, filed on Mar. 8, 2022 in Korean Intellectual Property Office, the disclosure of which is incorporated by reference in its entirety.

BACKGROUND

1. Field

The disclosure relates to a scroll compressor, and more particularly, to a scroll compressor having an oil supply groove capable of supplying oil to a compression chamber.

2. Description of the Related Art

A scroll compressor is a device that compresses a refrigerant by engaging a fixed scroll and an orbiting scroll each having a spiral wrap and turning the orbiting scroll relative to the fixed scroll fixed to a casing.

The scroll compressor has a plurality of compression pockets formed by the fixed scroll fixed inside the sealed casing and the orbiting scroll orbiting with respect to the fixed scroll. The plurality of compression pockets are gradually narrowed from the outer circumferential side of the fixed scroll toward the center thereof by the orbiting motion of the orbiting scroll. Refrigerant is sucked into the compression pocket located on the outer circumferential side of the fixed scroll, and is compressed while the compression pocket moves toward the center by turning of the orbiting scroll. When the compression pocket is located at the center of the fixed scroll, the maximum compressed refrigerant is discharged from the compression pocket into the sealed casing.

Recently, a system air conditioner is required to operate stably in a wide range of operating conditions using one compressor.

In order to satisfy the requirement of such a system air conditioner, the operating range of the compressor may be expanded.

Therefore, there is a demand for a compressor that may operate stably and reliably in a high compression ratio area.

SUMMARY

Aspects of embodiments of the disclosure will be set forth in part in the description which follows and, in part, will be apparent from the description, or may be learned by practice of the presented embodiments.

According to an embodiment of the disclosure, a scroll compressor may include a fixed scroll including a wrap accommodation portion having an inner space extending inside the wrap accommodation portion, a thrust surface formed around the inner space, a fixed wrap extending downward into the inner space, and an oil groove formed on the thrust surface; an orbiting scroll configured below the fixed scroll and to rotate with respect to the fixed scroll, the orbiting scroll including a mirror plate, an orbiting wrap extending from an upper surface of the mirror plate so as to engage with the fixed wrap of the fixed scroll, and at least one oil supply groove on the upper surface of the mirror plate so as to face the thrust surface of the fixed scroll; and a driving motor configured to rotate the orbiting scroll. The orbiting scroll may be configured so that when the orbiting scroll rotates, the at least one oil supply groove of the orbiting scroll moves from a first position to receive oil from the oil groove of the fixed scroll to a second position to supply the oil to the inner space of the wrap accommodation portion of the fixed scroll.

According to an embodiment of the disclosure, the at least one oil supply groove of the orbiting scroll is configured so that when the orbiting scroll rotates once, the at least one oil supply groove of the orbiting scroll faces the oil groove of the fixed scroll at least once in the first position, and faces the inner space of the wrap accommodation portion of the fixed scroll in the second position.

According to an embodiment of the disclosure, the at least one oil supply groove of the orbiting scroll is formed so as not to penetrate through to a bottom surface of the mirror plate.

According to an embodiment of the disclosure, the at least one oil supply groove of the orbiting scroll is formed adjacent to an outer end of the orbiting wrap.

According to an embodiment of the disclosure, the wrap accommodation portion of the fixed scroll includes a suction portion through which refrigerant is sucked into the inner space, and the oil groove of the fixed scroll is formed to surround an entire circumference of the inner space except for the suction portion.

According to an embodiment of the disclosure, the orbiting scroll further includes a first oil hole configured on the upper surface of the mirror plate to supply the oil to the oil groove of the fixed scroll.

According to an embodiment of the disclosure, the first oil hole is formed to face the oil groove of the fixed scroll at least once when the orbiting scroll rotates one time.

According to an embodiment of the disclosure, the orbiting scroll further includes a boss portion extending downward from a lower surface of the mirror plate, wherein the first oil hole is formed to communicate with an inner space of the boss portion.

According to an embodiment of the disclosure, the orbiting scroll further includes a second oil hole formed on the lower surface of the mirror plate to face the inner space of the boss portion; and an oil path formed inside the mirror plate of the orbiting scroll so as to connect the second oil hole and the first oil hole.

According to an embodiment of the disclosure, the oil path is formed so as to extend from an outer circumferential surface of the mirror plate toward a center of the mirror plate to meet the first oil hole and the second oil hole.

According to an embodiment of the disclosure, the orbiting scroll further includes an orifice pin disposed in the oil path.

According to an embodiment of the disclosure, the scroll compressor further includes a casing, and the driving motor includes a stator fixed to the casing; a rotor positioned inside the stator; a motor shaft fixed to a center of the rotor and having a first end coupled to the boss portion of the orbiting scroll; and an oil passage formed in a longitudinal direction inside the motor shaft, wherein the oil is accommodated in a lower portion of the casing, and the oil is supplied to the inner space of the boss portion of the orbiting scroll through the oil passage of the motor shaft.

According to an embodiment of the disclosure, the first oil hole is spaced apart at a predetermined angle from the at least one oil supply groove of the orbiting scroll.

According to an embodiment of the disclosure, the first oil hole and the at least one oil supply groove of the orbiting scroll are spaced apart from each other so that the first oil hole is adjacent to a first end of the oil groove of the fixed scroll, and the at least one oil supply groove of the orbiting scroll is adjacent to a second end of the oil groove of the fixed scroll.

According to an embodiment of the disclosure, when the first oil hole faces the oil groove of the fixed scroll, the at least one oil supply groove of the orbiting scroll faces the oil groove of the fixed scroll.

BRIEF DESCRIPTION OF THE DRAWINGS

These and/or other aspects, features, and advantages of certain embodiments of the disclosure will be more apparent from the following description taken in conjunction with the accompanying drawings, in which.

DETAILED DESCRIPTION

Descriptions below, which take into reference the accompanying drawings, are provided to assist in a comprehensive understanding of various embodiments of the disclosure as defined by the claims and its equivalent. Although various specific details are included to assist in the understanding herein, the above are to be understood as merely example embodiments. Accordingly, it will be understood by those of ordinary skill in the art that various modifications may be made to various embodiments described herein without departing from the scope and spirit of the disclosure. In addition, descriptions on well-known functions and configurations will be omitted for clarity and conciseness.

Terms and words used in the description below and in the claims are not limited to its bibliographical meaning, and are used merely to assist in a clear and coherent understanding of the disclosure. Accordingly, the description below of the various embodiments of the disclosure are provided simply as examples and it will be clear to those of ordinary skill in the art that the example embodiments as defined by the appended claims and its equivalent are not for limiting the disclosure.

Terms such as first and second may be used in describing various elements, but the elements are not limited by the above-described terms. The above-described terms may be used only for the purpose of distinguishing one element from another element. For example, a first element may be designated as a second element, and likewise, a second element may be designated as a first element without exceeding the scope of protection.

The terms used in the embodiments of the disclosure may be interpreted to have meanings generally understood to one of ordinary skill in the art unless otherwise defined.

In addition, terms such as 'tip end,' 'back end,' 'upper part,' 'lower part,' 'upper end,' 'lower end,' and the like used in the disclosure may be defined based on the drawings, and forms and locations of each element are not limited by these terms.

The disclosure has been devised in view of the above problems, and an object of the disclosure is to provide a scroll compressor capable of operating stably and reliably in a high compression ratio region.

Hereinafter, a scroll compressor according to an embodiment of the disclosure will be described in detail with reference to the accompanied drawings.

Figure 1:
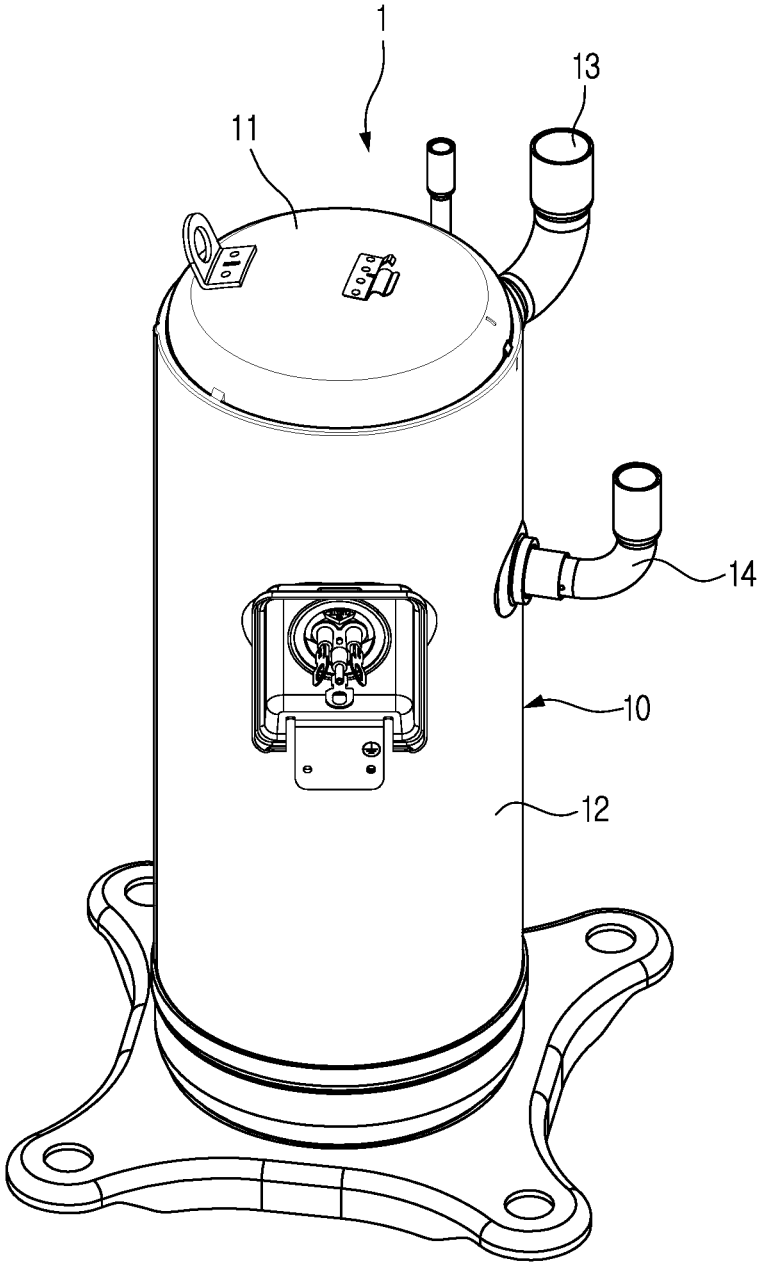
FIG. 1 is a perspective view illustrating a scroll compressor according to an embodiment of the disclosure.
Figure 2:
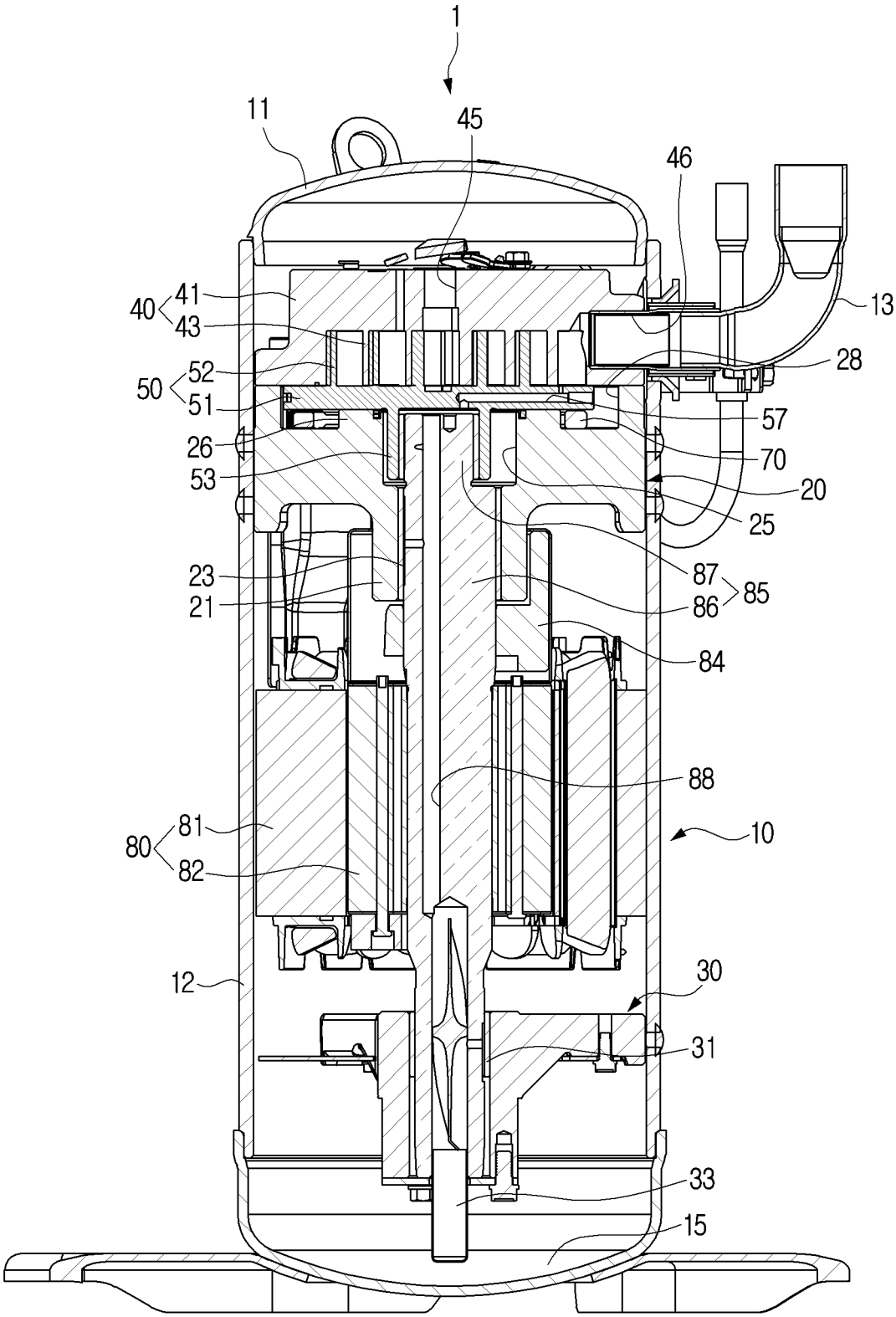
FIG. 2 is a longitudinal cross-sectional view illustrating a scroll compressor according to an embodiment of the disclosure.
Figure 3:
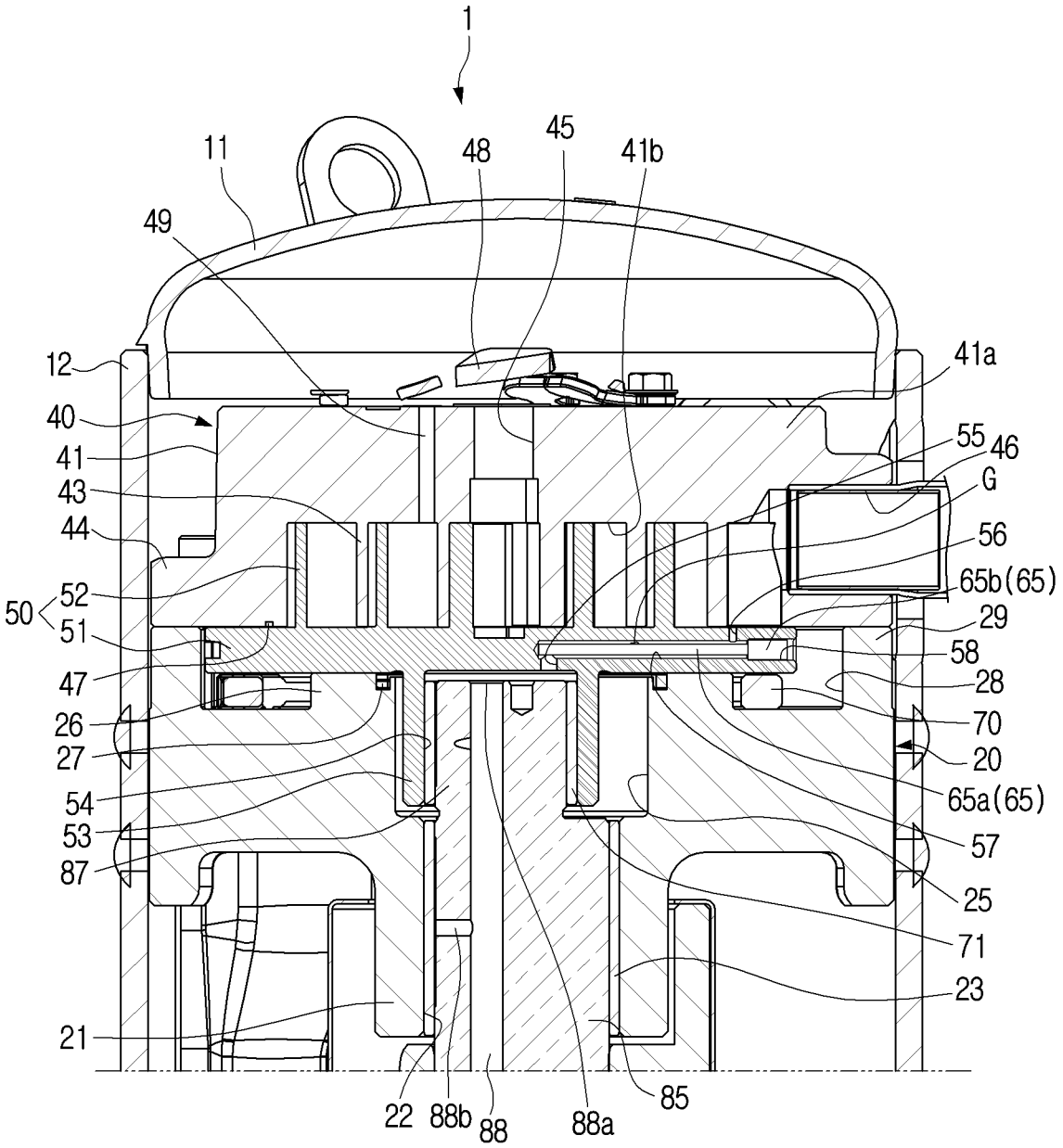
FIG. 3 is an enlarged cross-sectional view of the upper portion of the scroll compressor of FIG. 2 according to an embodiment of the disclosure.

FIG. 1 is a perspective view illustrating a scroll compressor according to an embodiment of the disclosure. FIG. 2 is a longitudinal cross-sectional view illustrating a scroll compressor according to an embodiment of the disclosure. FIG. 3 is an enlarged cross-sectional view of the upper portion of the scroll compressor of FIG. 2.

Referring to FIGS. 1 to 3, a scroll compressor 1 according to an embodiment of the disclosure may include a casing 10, a main frame 20, a sub frame 30, a fixed scroll 40, an orbiting scroll 50, and a driving motor 80.

The casing 10 is an airtight container having a cylindrical shape and may include an upper casing 11 and a lower casing 12. The main frame 20, the sub frame 30, the fixed scroll 40, the orbiting scroll 50, and the driving motor 80 may be accommodated inside the casing 10.

A refrigerant inlet pipe 13 through which refrigerant is introduced and a refrigerant discharge pipe 14 through which refrigerant is discharged may be disposed in the casing 10.

The refrigerant inlet pipe 13 passes through the casing 10 and has one end connected to the fixed scroll 40. The refrigerant discharge pipe 14 passes through the casing 10, and one end thereof may communicate with the inside of the casing 10.

Therefore, the refrigerant may flow into the fixed scroll 40 disposed in the casing 10 through the refrigerant inlet pipe 13, and the compressed refrigerant discharged from the fixed scroll 40 may be discharged to the outside of the casing 10 through the refrigerant discharge pipe 14.

The main frame 20 and the sub frame 30 are spaced apart at a predetermined distance vertically and are fixed inside the casing 10. The driving motor 80 for rotating the orbiting scroll 50 may be disposed between the main frame 20 and the sub frame 30.

The fixed scroll 40 and the orbiting scroll 50 may be disposed on the upper side of the main frame 20. An oil reservoir 15 storing oil or lubricating oil for lubricating and cooling parts accommodated inside the casing 10 may be provided below the sub frame 30 in a lower portion of the casing 10.

The main frame 20 may be formed in a substantially disc shape, and may have a protrusion portion 21 formed on the lower surface of the main frame 20. A shaft support hole 22 may be formed in the protrusion portion 21 of the main frame 20. A bearing metal 23 supporting a motor shaft 85 may be disposed in the shaft support hole 22.

The motor shaft 85 is inserted through the bearing metal 23, so that the bearing metal 23 may support rotation of the motor shaft 85.

A boss insertion groove 25 having an inner diameter larger than the inner diameter of the shaft support hole 22 may be provided on the upper side of the shaft support hole 22. The shaft support hole 22 and the boss insertion groove 25 may be formed concentrically.

An annular protrusion 26 forming an upper end of the boss insertion groove 25 may be provided on the upper surface of the main frame 20. The upper surface of the annular protrusion 26 may be formed as a mirror surface that contacts and supports a mirror plate 51 of the orbiting scroll 50.

In addition, a ring groove may be formed on the upper surface of the annular protrusion 26 to surround the boss insertion groove 25. An oil ring 27 may be disposed in the ring groove.

An annular groove 28 may be provided outside the annular protrusion 26. The annular groove 28 may be formed by the annular protrusion 26 and an extension wall 29 extending upward along the edge of the upper surface of the main frame 20. The annular groove 28 may form a back pressure chamber together with the fixed scroll 40 and the orbiting scroll 50. Oil supplied from the oil reservoir 15 may be filled in the back pressure chamber.

In addition, an anti-rotation mechanism 70 may be disposed in the back pressure chamber between the orbiting scroll 50 and the main frame 20 to prevent the orbiting scroll 50 from rotating on its own axis. An Oldham ring may be used as the anti-rotation mechanism 70.

The fixed scroll 40 is disposed on the upper side of the main frame 20. The fixed scroll 40 is fixed to the upper end of the extension wall 29 of the main frame 20. The orbiting scroll 50 may be accommodated in a space formed by the fixed scroll 40 and the main frame 20.

The orbiting scroll 50 engages with the fixed scroll 40 and is disposed between the fixed scroll 40 and the main frame 20 so as to be capable of orbiting motion with respect to the fixed scroll 40.

The fixed scroll 40 may include a wrap accommodation portion 41, a flange 44 provided around the wrap accommodation portion 41, and a fixed wrap 43 provided in the inner space 42 of the wrap accommodation portion 41.

The wrap accommodation portion 41 may be formed in a shape that is able to be accommodated inside the casing 10. A fixed mirror surface **41*b* may be formed on the surface of the wrap accommodation portion 41 facing the upper end of the orbiting scroll 50**.

The fixed wrap 43 extends vertically from the fixed mirror surface **41*b* of the wrap accommodation portion 41 and may be formed in a spiral shape. The fixed wrap 43** may be formed as a curved surface having a predetermined thickness and height.

A discharge port 45 through which the refrigerant compressed by the fixed scroll 40 and the orbiting scroll 50 is discharged and a check valve 48 configured to open and close the discharge port 45 may be provided on the upper surface of the fixed scroll 40.

An inlet 46 through which refrigerant flows may be formed on a side surface of the fixed scroll 40. The inlet 46 may be connected to the refrigerant inlet pipe 13 disposed in the casing 10. Accordingly, the refrigerant introduced through the refrigerant inlet pipe 13 may be drawn into the fixed scroll 40 through the inlet 46.

The orbiting scroll 50 is disposed below the fixed scroll 40 so as to be able to rotate with respect to the fixed scroll 40. The orbiting scroll 50 may include the mirror plate 51, an orbiting wrap 52, and a boss portion 53.

The mirror plate 51 is formed in a disk shape having a predetermined thickness and area. An orbiting mirror surface may be formed on the upper surface of the mirror plate 51 facing the fixed scroll 40.

The orbiting wrap 52 extends vertically from the upper surface of the mirror plate 51 and may be formed in a spiral shape. The orbiting wrap 52 is formed to engage with the fixed wrap 43 of the fixed scroll 40.

The boss portion 53 may be formed in the center of the lower surface of the mirror plate 51 opposite to the orbiting mirror surface. An upper end portion 87 of the motor shaft 85 may be inserted into the inner space 54 of the boss portion 53. In other words, the upper end portion 87 of the motor shaft 85 is coupled to the boss portion 53.

The orbiting wrap 52 of the orbiting scroll 50 may be engaged with the fixed wrap 43 of the fixed scroll 40, and the boss portion 53 may be inserted into the boss insertion groove 25 of the main frame 20. In addition, the lower surface of the mirror plate 51 on which the boss portion 53 is formed may be supported by the mirror surface of the main frame 20. Accordingly, the lower surface of the mirror plate 51 supported by the mirror surface of the main frame 20 may be formed as a mirror surface.

The fixed wrap 43 of the fixed scroll 40 and the orbiting wrap 52 of the orbiting scroll 50 are accommodated in the wrap accommodation portion 41 of the fixed scroll 40. The inner space 42 of the wrap accommodation portion 41 of the fixed scroll 40 forms a compression chamber.

The interlocking fixed wrap 43 and orbiting wrap 52 form a plurality of compression pockets. When the orbiting scroll 50 rotates, the plurality of compression pockets compress the refrigerant drawn into the inlet 46 of the fixed scroll 40 while moving to the center of the wrap accommodation portion 41 and discharge the compressed refrigerant through the discharge port 45.

The driving motor 80 may include a stator 81 and a rotor 82. The stator 81 may be fixed to the inner surface of the casing 10. The rotor 82 may be rotatably inserted inside the stator 81.

In addition, the motor shaft 85 may be inserted into the rotor 82 to penetrate the rotor 82. Because the rotor 82 is fixed to the motor shaft 85, the rotor 82 and the motor shaft 85 may rotate integrally.

The motor shaft 85 may include a shaft portion 86 formed to have a predetermined length and an eccentric portion 87 extending upward from an upper end of the shaft portion 86. The eccentric portion 87 may form the upper end portion of the motor shaft 85. The central axis of the eccentric portion 87 is spaced apart by a predetermined distance from the rotational center of the motor shaft 85, that is, the central axis of the shaft portion 86.

The rotor 82 of the driving motor 80 may be fixed to the shaft portion 86 of the motor shaft 85. One end of the shaft portion 86 may be inserted into the protrusion portion 21 of the main frame 20, and may be rotatably supported by the bearing metal 23 disposed in the protrusion portion 21.

The upper end portion of the motor shaft 85, that is, the eccentric portion 87 may be inserted into the boss portion 53 of the orbiting scroll 50. A bearing metal 71 may be provided between the eccentric portion 87 of the motor shaft 85 and the boss portion 53 of the orbiting scroll 50.

A balance weight 84 may be provided above the rotor 82 on the shaft portion 86 of the motor shaft 85. In other words, the balance weight 84 may be disposed on the shaft portion 86 between the rotor 82 and the main frame 20.

A lower portion of the shaft portion 86 may be supported by a bearing metal 31 disposed on the sub frame 30 fixed to the casing 10. Accordingly, the motor shaft 85 may rotate while being supported at both ends thereof by the main frame 20 and the sub frame 30.

In addition, an oil passage 88 may be formed in the motor shaft 85 to pass through the shaft portion 86 and the eccentric portion 87. An outlet 88*a* of the oil passage 88 is provided at an upper end of the eccentric portion 87. Accordingly, the oil that has moved through the oil passage 88 may be discharged to the inner space 54 of the boss portion 53 of the orbiting scroll 50. In other words, the oil moved through the oil passage 88 may discharged to the inner space 54 of the boss portion 53 above the eccentric portion 87 of the motor shaft 85.

An oil supply device 33 for supplying oil from the oil reservoir 15 to the oil passage 88 may be disposed at the lower end of the motor shaft 85. The lower end of the oil supply device 33 may be submerged in the oil reservoir 15 of the casing 10.

Therefore, when the motor shaft 85 rotates, the oil stored in the oil reservoir 15 may be supplied to the oil passage 88 of the motor shaft 85 by the pressure acting on the oil reservoir 15 and the oil supply device 33.

The oil moved along the oil passage 88 may be supplied to the inner space 54 of the boss portion 53 of the orbiting scroll 50 through the outlet 88*a*. In addition, some of the oil moving through the oil passage 88 may be supplied to the bearing metal 23 of the main frame 20 through a side outlet 88*b*.

Hereinafter, the fixed scroll 40 of the scroll compressor 1 according to an embodiment of the disclosure will be described in detail with reference to FIGS. 4 and 5.

Figure 4:
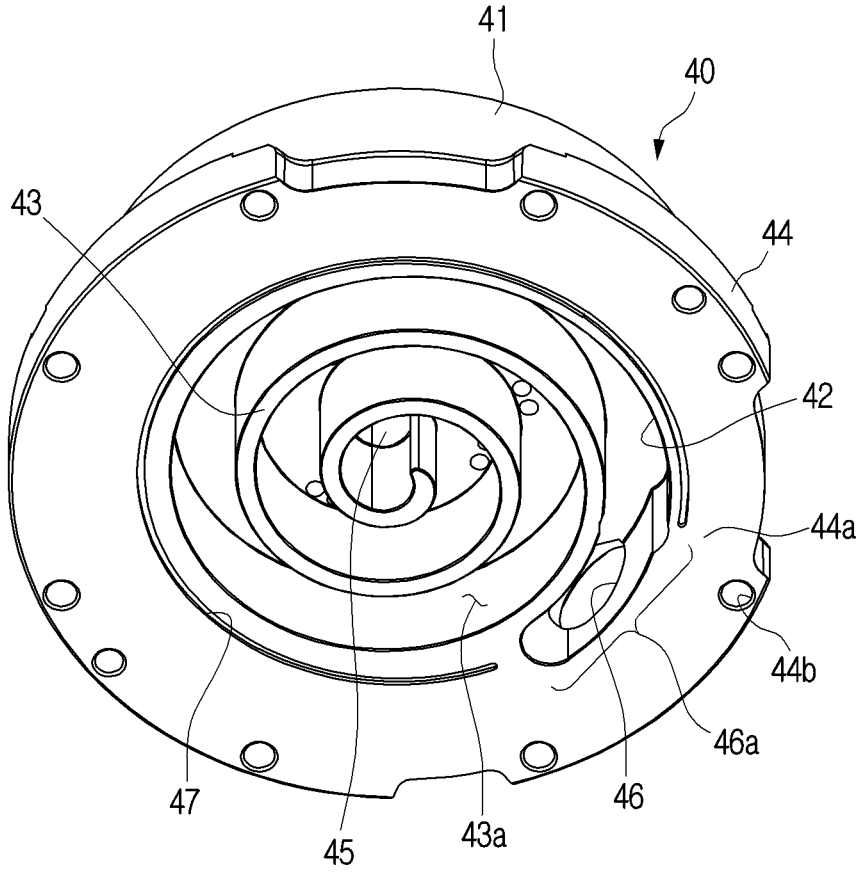
FIG. 4 is a bottom perspective view illustrating a fixed scroll of a scroll compressor according to an embodiment of the disclosure.

FIG. 4 is a bottom perspective view illustrating a fixed scroll of a scroll compressor according to an embodiment of the disclosure. FIG. 5 is a bottom view of the fixed scroll of FIG. 4.

Figure 5:
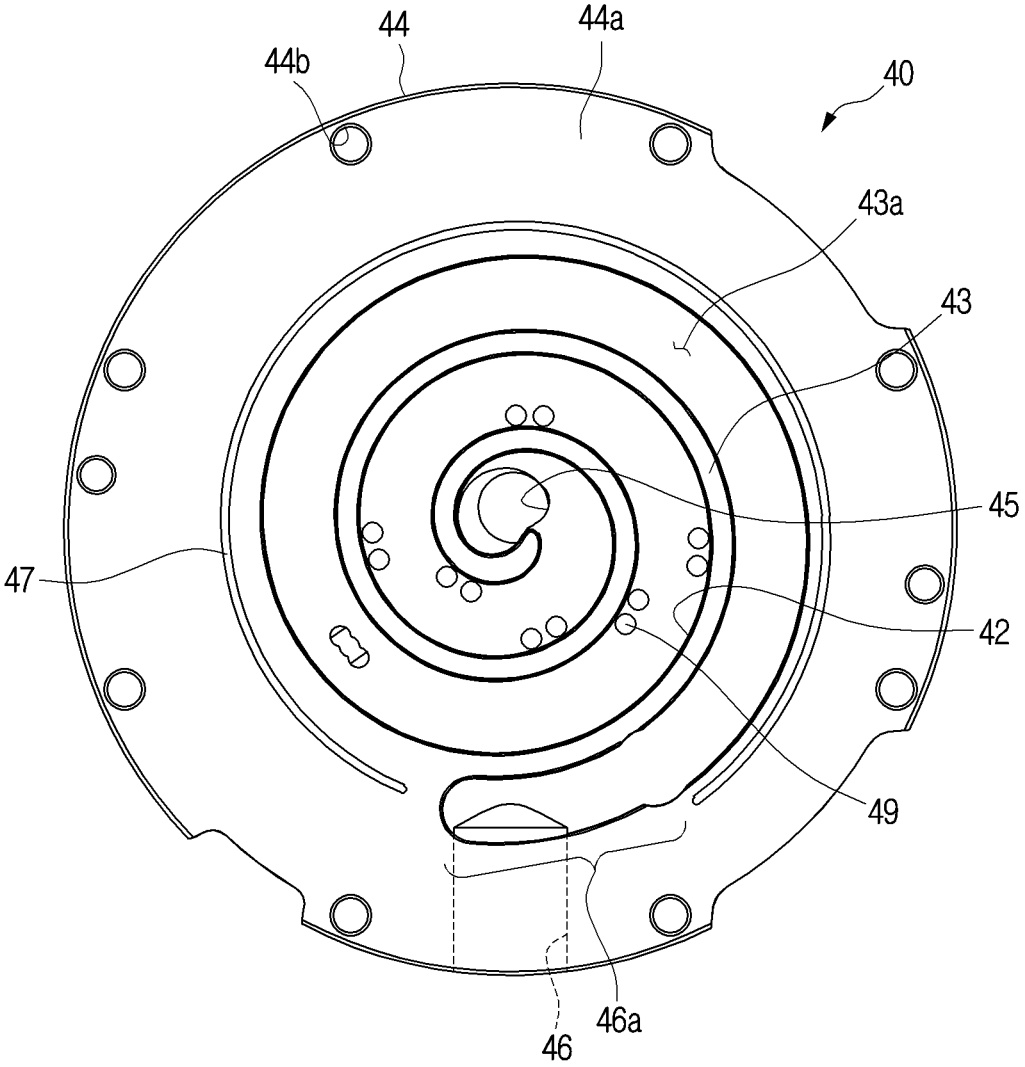
FIG. 5 is a bottom view of the fixed scroll of FIG. 4 according to an embodiment of the disclosure.

Referring to FIGS. 4 and 5, the fixed scroll 40 may include the wrap accommodation portion 41 and the fixed wrap 43 as described above.

The wrap accommodation portion 41 may be accommodated inside the casing 10 and may be formed in a substantially hollow cylindrical shape. For example, the wrap accommodation portion 41 may include a side wall having a cylindrical shape and an upper plate 41*a* formed to block the upper end of the side wall.

The flange 44 extending toward the outside may be provided at a lower end of the wrap accommodation portion 41. The lower surface of the flange 44, that is, the surface in contact with the mirror plate 51 of the orbiting scroll 50 forms a thrust surface 44*a*.

A plurality of through holes 44*b* for coupling with the main frame 20 may be formed at the edge of the flange 44. Accordingly, the fixed scroll 40 may be fixed to the main frame 20 with a plurality of bolts inserted into the plurality of through holes 44*b* of the flange 44.

The upper plate 41*a* of the wrap accommodation portion 41 is formed in a disk shape, and may be provided with the discharge port 45 through which refrigerant is discharged and a plurality of release holes 49. The check valve 48 configured to open and close the discharge port 45 and a plurality of release valves configured to open and close the plurality of release holes 49 may be provided on the upper surface of the upper plate 41*a*.

The fixed mirror surface 41*b* may be formed on the lower surface of the upper plate 41*a* facing the orbiting scroll 50. Accordingly, the upper end of the orbiting wrap 52 of the orbiting scroll 50 may contact the fixed mirror surface 41*b* of the fixed scroll 40.

The fixed wrap 43 is provided in the wrap accommodation portion 41. The fixed wrap 43 extends perpendicularly from the fixed mirror surface 41*b* of the wrap accommodation portion 41 and may be formed as a spiral curved surface having a predetermined thickness and height.

For example, the fixed wrap 43 may be formed as a curved surface. An inner curve forming the inner surface of the fixed wrap 43 and an outer curve forming the outer surface of the fixed wrap 43 may be formed as an involute curve, a hybrid curve, or the like.

In addition, the fixed wrap 43 may be formed as a curved surface whose curvature continuously increases from the periphery of the wrap accommodation portion 41 of the fixed scroll 40 toward the center of the wrap accommodation portion 41. In other words, the fixed wrap 43 may be formed as a curved surface whose radius of curvature continuously decreases from the periphery of the wrap accommodation portion 41 of the fixed scroll 40 toward the center of the wrap accommodation portion 41.

A spiral-shaped space, that is, a spiral space 43*a* is formed in the inner space 42 of the wrap accommodation portion 41 by the fixed wrap 43. The orbiting wrap 52 of the orbiting scroll 50 is inserted into the spiral space 43*a* of the wrap accommodation portion 41 of the fixed scroll 40.

The discharge port 45 may be formed in the center of the wrap accommodation portion 41 so as to pass through the upper plate 41*a* of the wrap accommodation portion 41. In other words, the discharge port 45 may be formed adjacent to the center of the spiral space 43*a* formed by the fixed wrap 43.

The inlet 46 is formed to pass through the side wall of the wrap accommodation portion 41. The inlet 46 may be formed adjacent to an outer end of the spiral space 43*a*. Accordingly, the refrigerant may flow into the spiral space 43*a* of the fixed scroll 40 through the inlet 46. A portion of the wrap accommodation portion 41 provided with the inlet 46, that is, the outer end of the spiral space 43*a* may form a suction portion 46*a* into the which the refrigerant is sucked.

An oil groove 47 may be formed on the thrust surface 44*a* of the fixed scroll 40. The oil groove 47 may be formed in a predetermined depth on the thrust surface 44*a*. For example, the cross-section of the oil groove 47 may be formed in a substantially U-shape with a flat bottom.

The oil groove 47 may be formed in an arc shape surrounding the wrap accommodation portion 41. The oil groove 47 may be formed to surround most of the circumference of the wrap accommodation portion 41. The oil groove 47 may be formed to surround more than ¾ of the circumference of the wrap accommodation portion 41. However, the oil groove 47 may be formed so as not to surround the entire circumference of the wrap accommodation portion 41. For example, the oil groove 47 may be formed to surround the entire circumference of the wrap accommodation portion 41 except for the suction portion 46*a*.

Hereinafter, the orbiting scroll 50 of the scroll compressor 1 according to an embodiment of the disclosure will be described in detail with reference to FIGS. 6 to 8.

Figure 6:
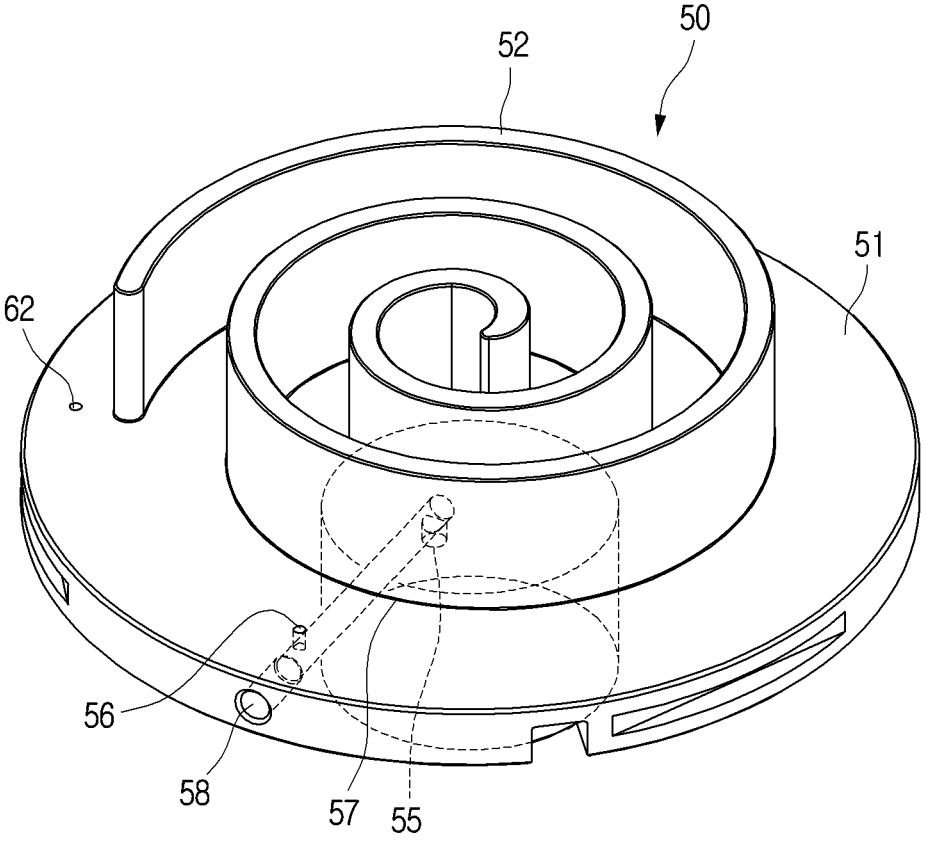
FIG. 6 is a perspective view illustrating an orbiting scroll of a scroll compressor according to an embodiment of the disclosure.

FIG. 6 is a perspective view illustrating an orbiting scroll of a scroll compressor according to an embodiment of the disclosure. FIG. 7 is a bottom perspective view illustrating an orbiting scroll of a scroll compressor according to an embodiment of the disclosure. FIG. 8 is a plan view of the orbiting scroll of FIG. 6.

Figure 7:
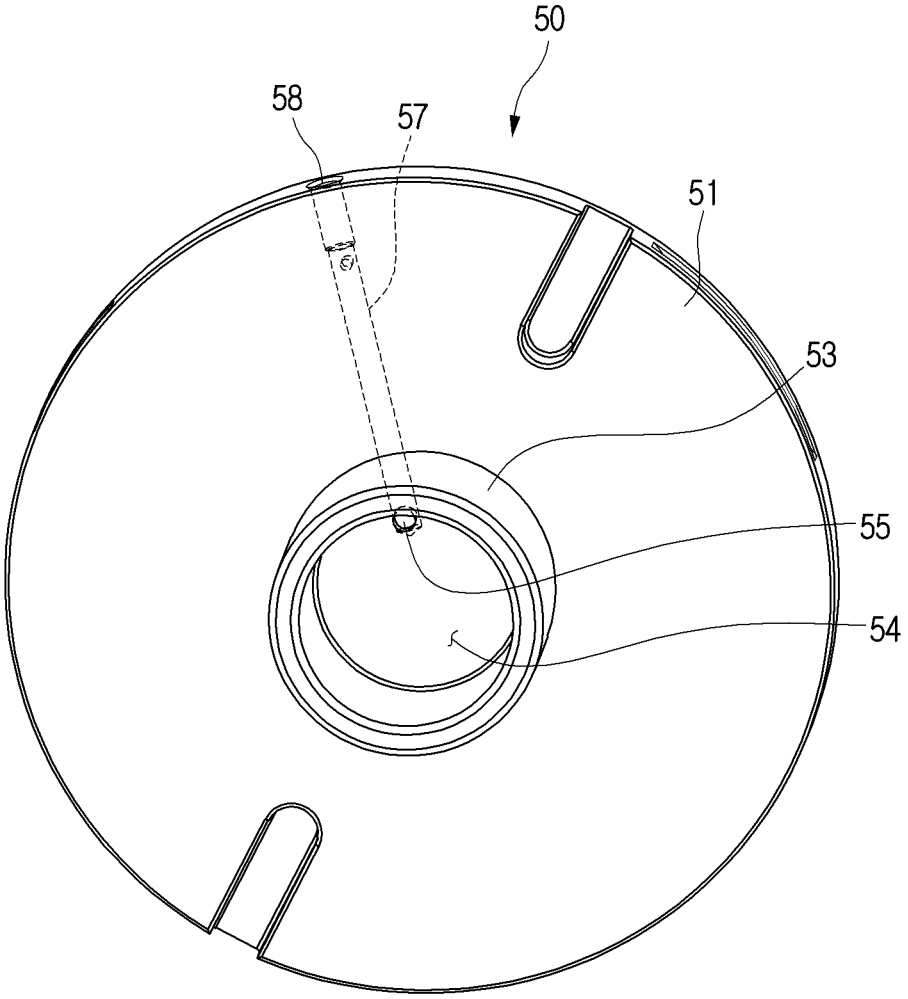
FIG. 7 is a bottom perspective view illustrating an orbiting scroll of a scroll compressor according to an embodiment of the disclosure.
Figure 8:
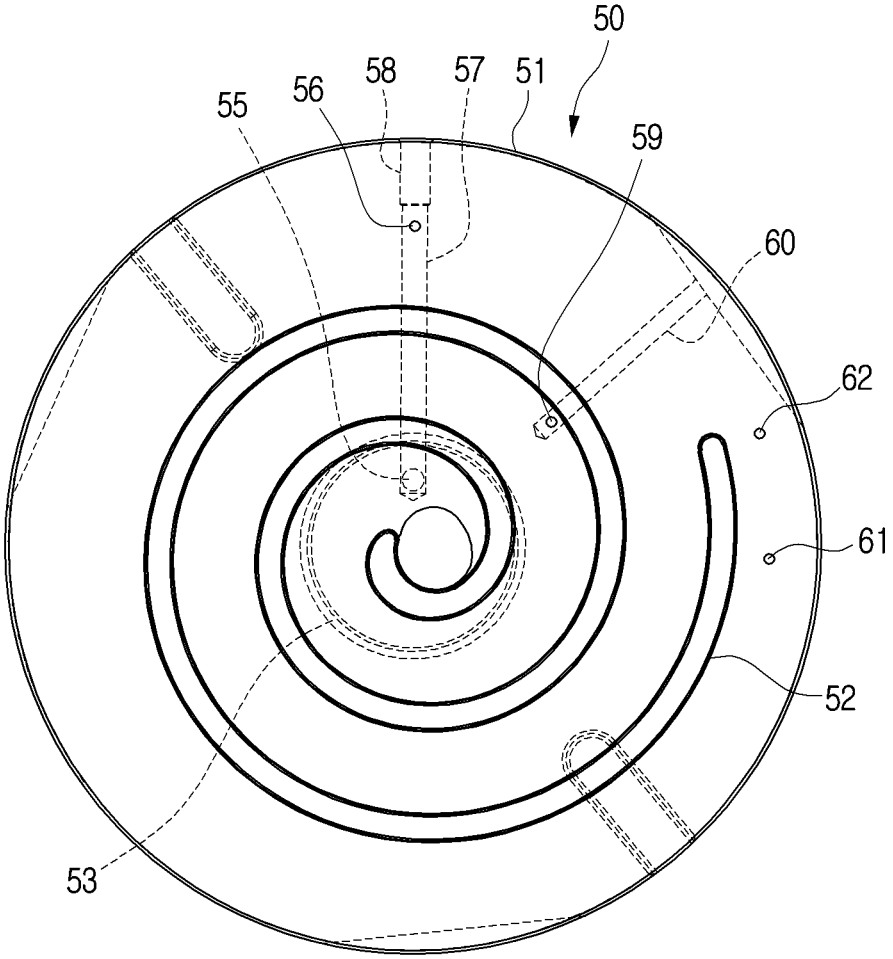
FIG. 8 is a plan view of the orbiting scroll of FIG. 6 according to an embodiment of the disclosure.

Referring to FIGS. 6 to 8, the orbiting scroll 50 may include the mirror plate 51, the orbiting wrap 52, and the boss portion 53.

The mirror plate 51 may be formed in a disk shape having a predetermined thickness. An orbiting mirror surface may be formed on the upper surface of the mirror plate 51 facing the fixed scroll 40.

The orbiting wrap 52 extends vertically from the upper surface of the mirror plate 51, that is, the orbiting mirror surface, and may be formed in a spiral shape. The orbiting wrap 52 may be formed as a curved surface having a predetermined thickness and height.

For example, the orbiting wrap 52 may be formed as a curved surface. An inner curve forming the inner surface of the orbiting wrap 52 and an outer curve forming the outer surface of the orbiting wrap 52 may be formed as an involute curve, a hybrid curve, or the like. The orbiting wrap 52 may be formed to engage with the fixed wrap 43 of the fixed scroll 40.

The boss portion 53 may be formed in the center of the lower surface of the mirror plate 51 opposite to the orbital mirror surface. The boss portion 53 has a hollow cylindrical shape and is formed to extend downward from the lower surface of the mirror plate 51.

The eccentric portion 87 provided at the upper end of the motor shaft 85 may be inserted into the inner space 54 of the boss portion 53. In other words, the eccentric portion 87 of the motor shaft 85 is coupled to the boss portion 53. Therefore, when the motor shaft 85 rotates, the orbiting scroll 50 may rotate.

The orbiting wrap 52 of the orbiting scroll 50 is inserted into the inner space 42 of the wrap accommodation portion 41 of the fixed scroll 40 and engaged with the fixed wrap 43. The boss portion 53 may be inserted into the boss insertion groove 25 of the main frame 20.

In addition, the lower surface of the mirror plate 51 on which the boss portion 53 is formed may be supported by the mirror surface of the main frame 20. Accordingly, the lower surface of the mirror plate 51 supported by the mirror surface of the main frame 20 may be formed as a mirror surface.

The orbiting scroll 50 may be formed to supply oil supplied through the oil passage 88 of the motor shaft 85 to the oil groove 47 of the fixed scroll 40.

To this end, an oil hole 56 for supplying oil to the oil groove 47 of the fixed scroll 40 may be formed in the mirror plate 51 of the orbiting scroll 50. The oil hole 56 is formed on the upper surface of the mirror plate 51. The oil hole 56 is formed so as not to penetrate fully through to the bottom surface of the mirror plate 51.

The oil hole 56 may be formed to meet the oil groove 47 of the fixed scroll 40 at least once while the orbiting scroll 50 rotates once. In other words, the oil hole 56 may be formed on the upper surface of the mirror plate 51 so that the oil hole 56 is positioned directly below the oil groove 47 at least once while the orbiting scroll 50 rotates once.

When the oil hole 56 of the orbiting scroll 50 is positioned below the oil groove 47 of the fixed scroll 40, oil flows into the oil groove 47 of the fixed scroll 40 through the oil hole 56. Accordingly, while the orbiting scroll 50 rotates one time, oil is supplied to the oil groove 47 of the fixed scroll 40 at least once.

Because the oil groove 47 of the fixed scroll 40 is covered by the mirror plate 51 of the orbiting scroll 50, oil may be stored in the oil groove 47. In addition, when the orbiting scroll 50 rotates, the oil in the oil groove 47 adhered to the upper surface of the mirror plate 51 may be introduced into the wrap accommodation portion 41.

The oil hole 56 may be formed to communicate with the inner space 54 of the boss portion 53 provided on the lower surface of the orbiting scroll 50.

To this end, a lower oil hole 55 may be formed on the lower surface of the orbiting scroll 50 to face the inner space 54 of the boss portion 53. In other words, the lower oil hole 55 is provided inside the boss portion 53 on the lower surface of the mirror plate 51 of the orbiting scroll 50. The lower oil hole 55 is formed so as not to penetrate fully through the mirror plate 51 of the orbiting scroll 50. The lower oil hole 55 may be formed to have a larger diameter than the oil hole 56.

The lower oil hole 55 formed on the lower surface of the mirror plate 51 is spaced apart from the oil hole 56 formed on the upper surface of the mirror plate 51 by a predetermined distance. Accordingly, an oil path 57 connecting the lower oil hole 55 and the oil hole 56 may be provided in the mirror plate 51 of the orbiting scroll 50.

The oil path 57 may be formed from the outer circumferential surface of the mirror plate 51 toward the inside of the mirror plate 51. For example, the oil path 57 may be formed as a hole extending from the outer circumferential surface of the mirror plate 51 of the orbiting scroll 50 toward the center of the mirror plate 51 so as to meet the oil hole 56 and the lower oil hole 55.

The outer end of the oil path 57 formed on the outer circumferential surface of the mirror plate 51 is open, and the inner end of the oil path 57 formed inside the mirror plate 51 is closed. The oil path 57 is connected to the lower end of the oil hole 56 and the upper end of the lower oil hole 55. Thus, the oil hole 56 and the lower oil hole 55 communicate with each other through the oil path 57.

A fixing portion 58 may be formed at one end of the oil path 57. The fixing portion 58 is formed to form a step with the oil path 57. In detail, the fixing portion 58 is formed to have a larger diameter than the diameter of the oil path 57. One end of the fixing portion 58 is formed adjacent to the oil hole 56.

Referring to FIG. 3, an orifice pin 65 may be disposed in the oil path 57 and the fixing portion 58. The orifice pin 65 may include a pin portion 65*a* and a head portion 65*b*. The pin portion 65*a* is inserted into the oil path 57, and the head portion 65*b* is inserted into the fixing portion 58.

The diameter of the pin portion 65*a* of the orifice pin 65 is smaller than the inner diameter of the oil path 57. Accordingly, oil may move through a gap G between the pin portion 65*a* of the orifice pin 65 and the oil path 57.

The head portion 65*b* of the orifice pin 65 is formed to have a diameter capable of being inserted into and fixed to the fixing portion 58. Therefore, when the orifice pin 65 is inserted into the oil path 57 through the fixing portion 58, the head portion 65*b* of the orifice pin 65 is fixed to the fixing portion 58.

When the orifice pin 65 is disposed in the oil path 57, one end of the orifice pin 65 is in contact with or adjacent to the inner end of the oil path 57, and the head portion 65*b* of the orifice pin 65 does not block the oil hole 56.

Therefore, the oil supplied to the inner space 54 of the boss portion 53 of the orbiting scroll 50 through the oil passage 88 of the motor shaft 85 may be supplied to the upper side of the mirror plate 51 of the orbiting scroll 50 through the lower oil hole 55, the oil path 57, and the oil hole 56 of the orbiting scroll 50. In this case, the oil introduced into the lower oil hole 55 on the lower surface of the mirror plate 51 moves through the gap G between the inner circumferential surface of the oil path 57 and the orifice pin 65, and is discharged through the oil hole 56 on the upper surface of the mirror plate 51.

When the oil accommodated in the oil groove 47 of the fixed scroll 40 is supplied to the inner space of the wrap accommodation portion 41, that is, the compression chamber 42 by the rotation of the orbiting scroll 50, at a high compression ratio, the amount of oil supplied to the compression chamber 42 may be reduced. When the amount of oil supplied to the compression chamber 42 is small at the high compression ratio, wear may occur due to friction of the tip of the fixed wrap 43 and the tip of the orbiting wrap 52.

In order to solve this problem, at least one oil supply groove 61 and 62 may be provided on the upper surface of the mirror plate 51 of the orbiting scroll 50 to supply oil to the inner space of the wrap accommodation portion 41, that is, the compression chamber 42.

In other words, at least one oil supply groove 61 and 62 may be provided on the upper surface of the mirror plate 51 of the orbiting scroll 50 facing the thrust surface 44*a* of the fixed scroll 40. At least one oil supply groove 61 and 62 of the orbiting scroll 50 may be formed so that when the orbiting scroll 50 rotates, the at least one oil supply groove 61 and 62 receives oil from the oil groove 47 of the fixed scroll 40 and supplies the oil to the wrap accommodation portion 41 of the fixed scroll 40.

For example, at least one oil supply groove 61 and 62 may be formed at a position in which, during one rotation of the orbiting scroll 50, the at least one oil supply groove 61 and 62 faces the oil groove 47 of the fixed scroll 40 at least once and faces the wrap accommodation portion 41 of the fixed scroll 40 in a certain section. In other words, the at least one oil supply groove 61 and 62 may be formed on the upper surface of the mirror plate 51 of the orbiting scroll 50 so that while the orbiting scroll 50 rotates one time, the at least one oil supply groove 61 and 62 is located directly below the oil groove 47 of the fixed scroll 40 at least once, and the at least one oil supply groove 61 and 62 is located below and exposed in the inner space of the wrap accommodation portion 41, that is, the compression chamber 42 in a certain section.

When the at least one oil supply groove 61 and 62 is located below the oil groove 47 of the fixed scroll 40, the oil accommodated in the oil groove 47 may fill the at least one oil supply groove 61 and 62. On the other hand, when the at least one oil supply groove 61 and 62 is located in the compression chamber 42 of the fixed scroll 40, the oil accommodated in the at least one oil supply groove 61 and 62 may be supplied to the inside of the compression chamber 42 by the pressure of the compression chamber 42.

The at least one oil supply groove 61 and 62 may be formed as a groove having a predetermined cross-section. For example, the at least one oil supply groove 61 and 62 may be formed as a groove having a circular cross-section. However, the cross-section of the at least one oil supply groove 61 and 62 is not limited to a circular shape. The cross-section of the oil supply groove 61 and 62 may be formed in various shapes such as a rectangle, a triangle, an ellipse, or the like.

The volume of the at least one oil supply groove 61 and 62 may be determined according to the volume of the compression chamber 42 of the scroll compressor 1. When the volume of the compression chamber 42 is large and a lot of oil is required, the at least one oil supply groove 61 and 62 may be formed to have a large volume. However, the at least one oil supply groove 61 and 62 is formed so as not to penetrate fully through the mirror plate 51 of the orbiting scroll 50.

The at least one oil supply groove 61 and 62 may be formed adjacent to an outer end of the orbiting wrap 52. The at least one oil supply groove 61 and 62 may be spaced apart from the oil hole 56 at a predetermined angle.

Figure 9:
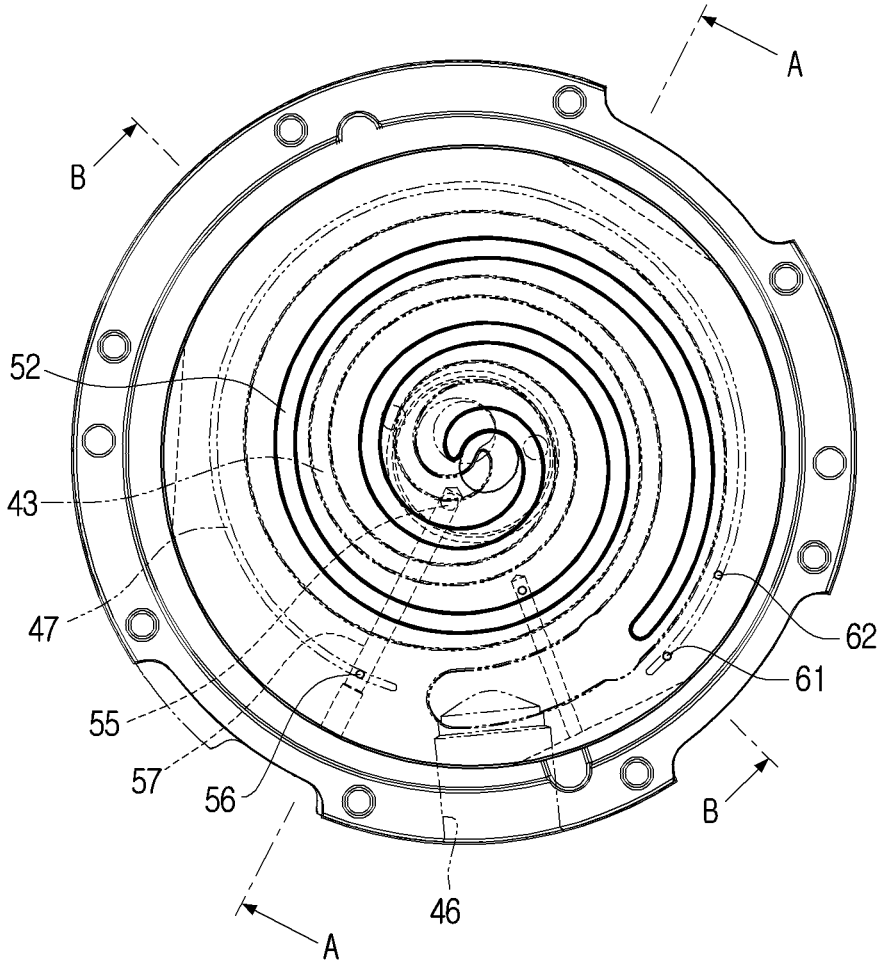
FIG. 9 is a view illustrating a case where an oil hole and two oil supply grooves of an orbiting scroll are located below an oil groove of a fixed scroll in a scroll compressor according to an embodiment of the disclosure.

For example, as illustrated in FIG. 9, the oil hole 56 and the at least one oil supply groove 61 and 62 may be spaced apart from each other so that when the oil hole 56 is adjacent to one end of the oil groove 47 of the fixed scroll 40, the at least one oil supply groove 61 and 62 is adjacent to the other end of the oil groove 47.

When the at least one oil supply groove 61 and 62 faces the oil groove 47 of the fixed scroll 40, the oil hole 56 of the orbiting scroll 50 may be provided to face the oil groove 47 of the fixed scroll 40. In other words, the oil hole 56 and the at least one oil supply groove 61 and 62 of the orbiting scroll 50 may be provided to be located below or out of the oil groove 47 of the fixed scroll 40 at the same time.

As another example, the oil hole 56 and the at least one oil supply groove 61 and 62 of the orbiting scroll 50 may be provided so as not to be located simultaneously below the oil groove 47 of the fixed scroll 40.

As illustrated in FIGS. 6 and 8, in this embodiment, two oil supply grooves 61 and 62, that is, a first oil supply groove 61 and a second oil supply groove 62 are formed on the mirror plate 51 of the orbiting scroll 50. However, the number of oil supply grooves 61 and 62 is not limited thereto. The oil supply grooves 61 and 62 may be provided in a quantity of one or three or more depending on the amount of oil to be supplied to the compression chamber 42.

Hereinafter, a process of supplying oil to the compression chamber 42 using at least one oil supply groove 61 and 62 in the scroll compressor 1 according to an embodiment of the disclosure will be described in detail with reference to FIGS. 9 to 22.

Figure 10:
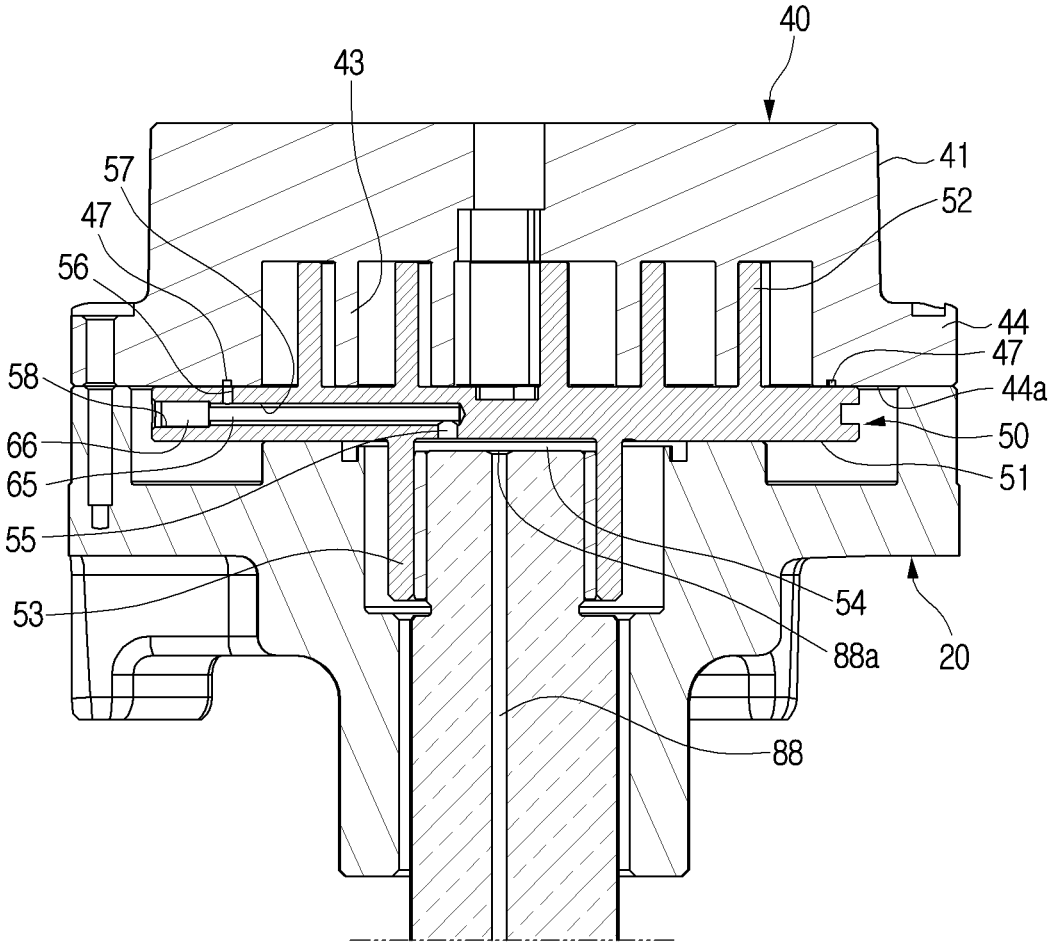
FIG. 10 is a cross-sectional view illustrating the scroll compressor of FIG. 9 taken along line A-A according to an embodiment of the disclosure.
Figure 11:
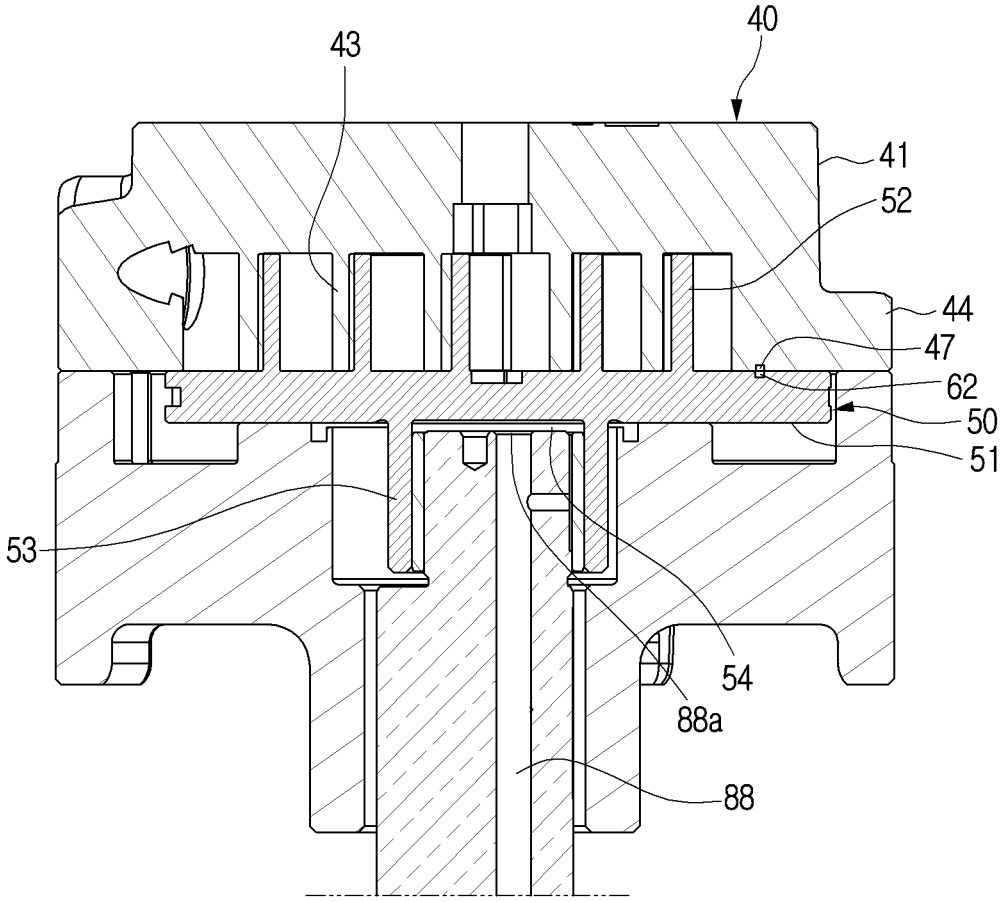
FIG. 11 is a cross-sectional view illustrating the scroll compressor of FIG. 9 taken along line B-B according to an embodiment of the disclosure.

FIG. 9 is a view illustrating a case where an oil hole and two oil supply grooves of an orbiting scroll are located below an oil groove of a fixed scroll in a scroll compressor according to an embodiment of the disclosure. FIG. 10 is a cross-sectional view illustrating the scroll compressor of FIG. 9 taken along line A-A. FIG. 11 is a cross-sectional view illustrating the scroll compressor of FIG. 9 taken along line B-B. For reference, in FIG. 9, the fixed scroll 40 is indicated by virtual lines to show the oil hole 56 and the oil supply groove 61 and 62 of the orbiting scroll 50.

Referring to FIGS. 9 and 10, the oil hole 56 of the orbiting scroll 50 is positioned below the oil groove 47 of the fixed scroll 40 so that the oil hole 56 faces the oil groove 47. In this case, the position of the oil groove 47 of the fixed scroll 40 where the oil hole 56 of the orbiting scroll 50 is positioned below the oil groove 47 of the fixed scroll 40 may be referred to as a first position.

When the oil hole 56 of the orbiting scroll 50 is located at the first position of the oil groove 47 of the fixed scroll 40, the oil hole 56 and the oil groove 47 coincide with each other, so that oil is supplied to the oil groove 47 of the fixed scroll 40 through the oil hole 56.

In detail, the oil in the oil reservoir 15 is supplied to the inner space 54 of the boss portion 53 in which the eccentric portion 87 of the motor shaft 85 is accommodated through the oil passage 88 of the motor shaft 85. The oil in the inner space 54 of the boss portion 53 flows into the oil path 57 through the lower oil hole 55 provided on the lower surface of the mirror plate 51 of the orbiting scroll 50. The oil flowing into the oil path 57 is supplied to the oil groove 47 of the fixed scroll 40 through the oil hole 56 provided on the upper surface of the mirror plate 51.

In addition, referring to FIGS. 9 and 11, when the oil hole 56 of the orbiting scroll 50 is located in the first position of the oil groove 47 of the fixed scroll 40, the two oil supply grooves 61 and 62 of the orbiting scroll 50, that is, the first oil supply groove 61 and the second oil supply groove 62 are located below the oil groove 47 of the fixed scroll 40, so that the first and second oil supply grooves 61 and 62 face the oil groove 47.

When the first and second oil supply grooves 61 and 62 of the orbiting scroll 50 are positioned below the oil groove 47 of the fixed scroll 40, each of the first and second oil supply grooves 61 and 62 coincides with the oil groove 47, so that the oil accommodated in the oil groove 47 of the fixed scroll 40 is supplied to the first and second oil supply grooves 61 and 62.

In a state where the fixed scroll 40 is stationary, the orbiting scroll 50 is rotated by the eccentric portion 87 of the motor shaft 85 eccentric with respect to the center of the fixed scroll 40.

Figure 12:
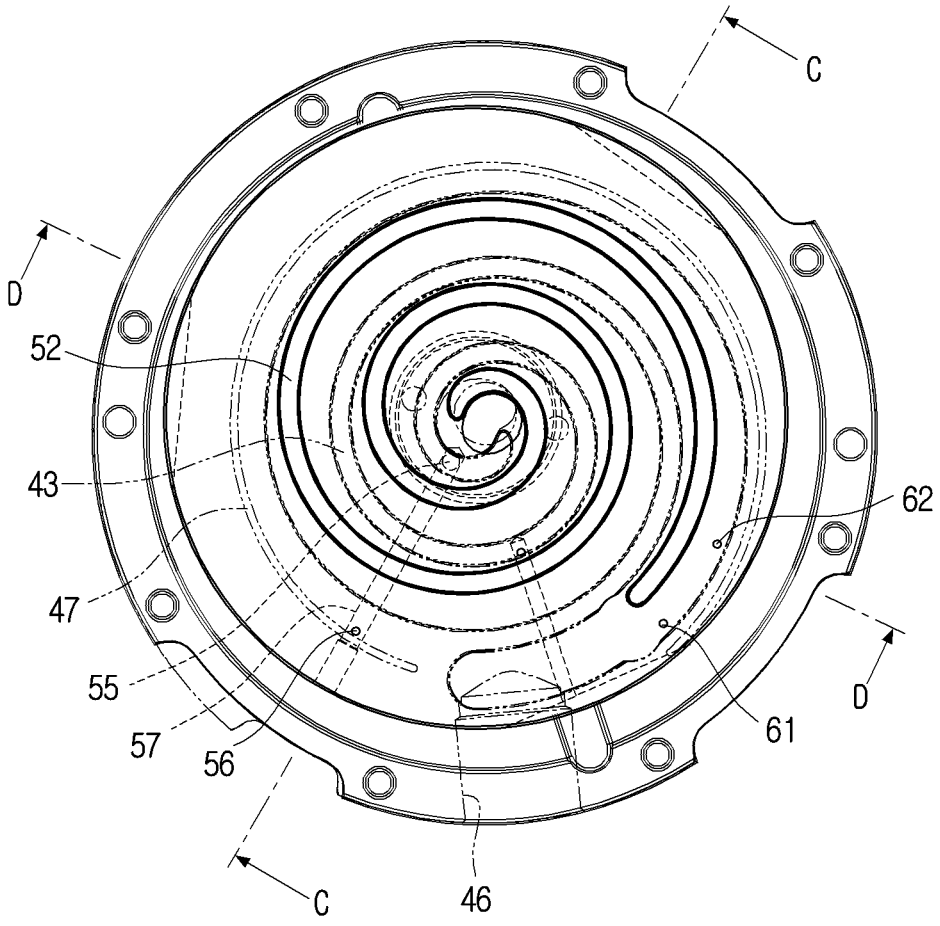
FIG. 12 is a view illustrating a case in which the orbiting scroll is rotated in a counter-clockwise direction by a predetermined angle in FIG. 9 so that the oil hole and two oil supply grooves of the orbiting scroll are located below the wrap accommodation portion of the fixed scroll according to an embodiment of the disclosure.

In the state of FIG. 9, when the orbiting scroll 50 rotates in the counter-clockwise direction at a predetermined angle, as illustrated in FIG. 12, the oil hole 56 of the orbiting scroll 50 is out of the oil groove 47 of the fixed scroll 40.

Figure 13:
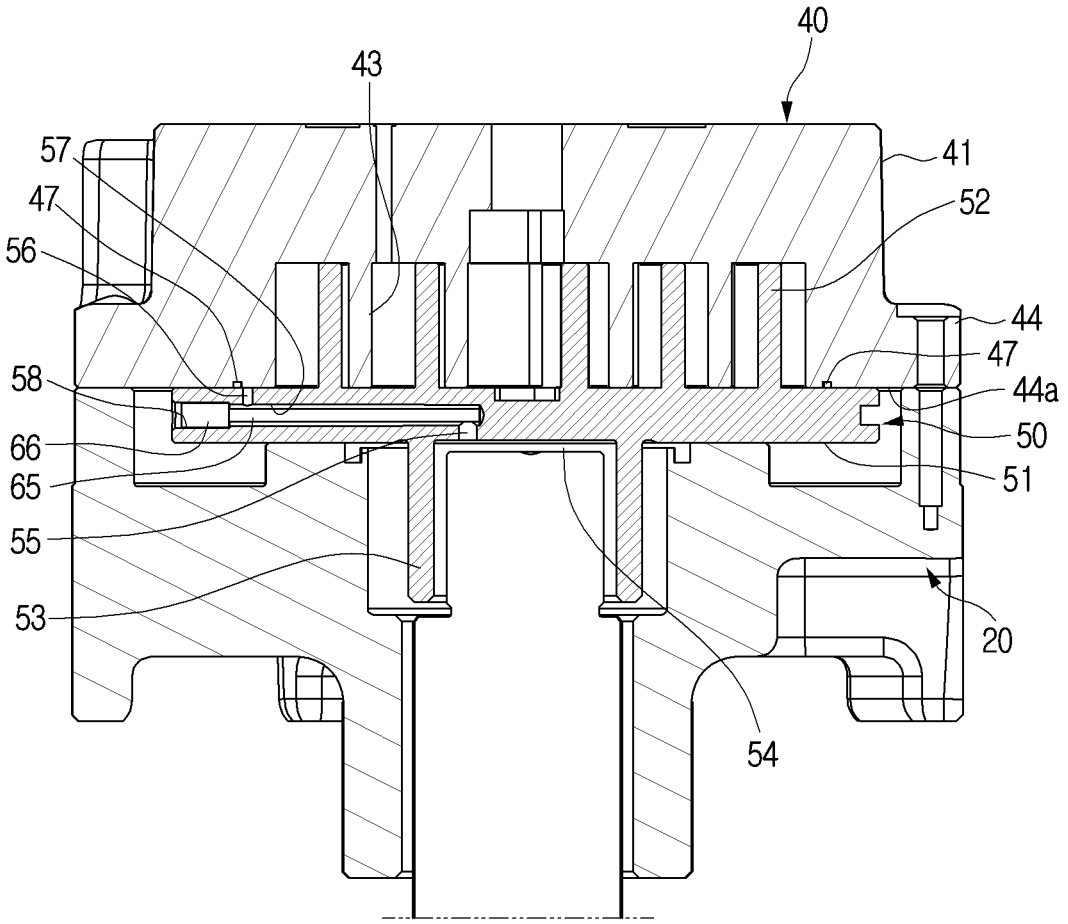
FIG. 13 is a cross-sectional view illustrating the scroll compressor of FIG. 12 taken along line C-C according to an embodiment of the disclosure.
Figure 14:
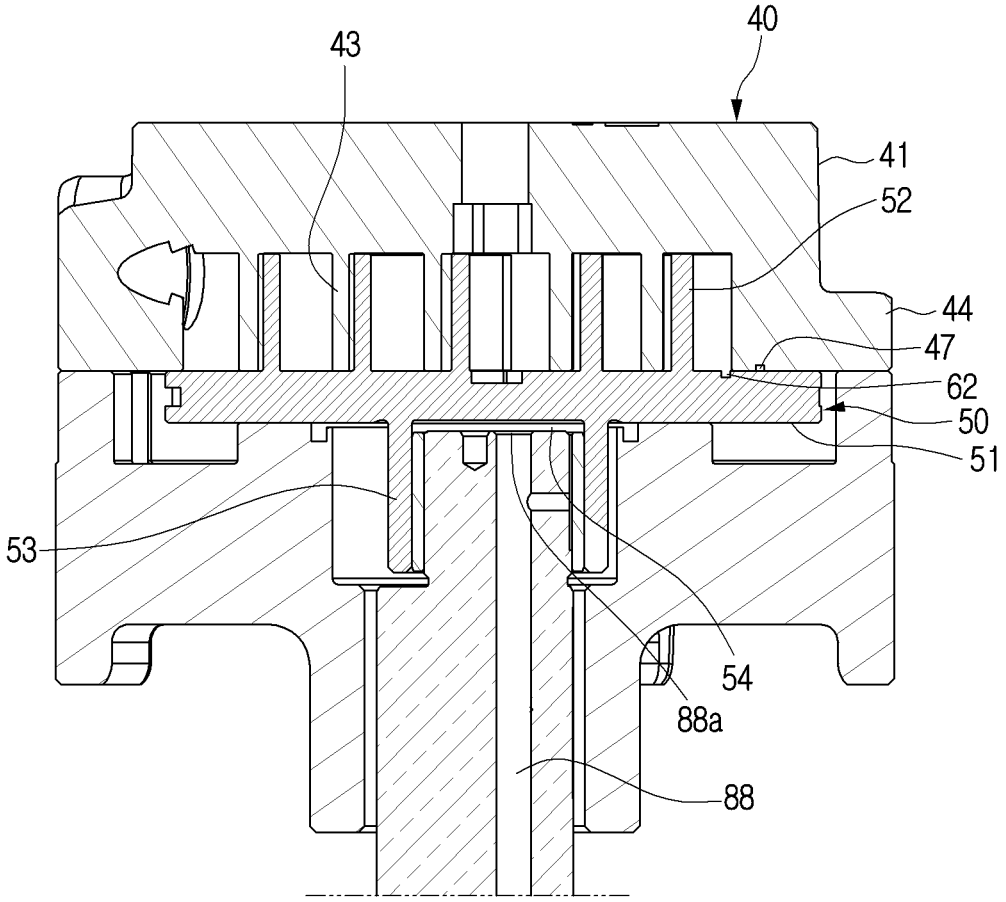
FIG. 14 is a cross-sectional view illustrating the scroll compressor of FIG. 12 taken along line D-D according to an embodiment of the disclosure.

FIG. 12 is a view illustrating a case in which the orbiting scroll is rotated in a counter-clockwise direction by a predetermined angle in FIG. 9 so that the oil hole and two oil supply grooves of the orbiting scroll are located below the wrap accommodation portion of the fixed scroll. FIG. 13 is a cross-sectional view illustrating the scroll compressor of FIG. 12 taken along line C-C. FIG. 14 is a cross-sectional view illustrating the scroll compressor of FIG. 12 taken along line D-D. For reference, in FIG. 12, the fixed scroll 40 is indicated by virtual lines to show the oil hole 56 and the oil supply grooves 61 and 62 of the orbiting scroll 50.

When the orbiting scroll 50 rotates at a predetermined angle in the counter-clockwise direction, as illustrated in FIGS. 12 and 13, the oil hole 56 of the orbiting scroll 50 gets out of the oil groove 47 of the fixed scroll 40 and is located in an inner area surrounded by the oil groove 47, that is, in an area close to the center of the fixed scroll 40. Then, the oil hole 56 of the orbiting scroll 50 faces the thrust surface **44*a* of the fixed scroll 40. At this time, the oil hole 56 of the orbiting scroll 50 and the oil groove 47 of the fixed scroll 40** do not coincide with each other.

When the oil hole 56 of the orbiting scroll 50 faces the thrust surface **44*a* of the fixed scroll 40, the oil hole 56 is covered by the thrust surface 44*a*, so that the oil in the oil path 57 is not supplied to the oil groove 47 of the fixed scroll 40**.

In addition, referring to FIGS. 12 and 14, when the oil hole 56 of the orbiting scroll 50 is located in the inner area surrounded by the oil groove 47 of the fixed scroll 40, the first oil supply groove 61 and the second oil supply groove 62 of the orbiting scroll 50 deviate from the oil groove 47 of the fixed scroll 40 and are located below the inner space of the wrap accommodation portion 41 of the fixed scroll 40, that is, in the compression chamber 42.

When the first oil supply groove 61 and the second oil supply groove 62 of the orbiting scroll 50 are located in the compression chamber 42 of the fixed scroll 40, the oil received in the first and second oil supply grooves 61 and 62 may be dispersed into the compression chamber 42 by the pressure of the refrigerant compressed in the compression chamber 42. In other words, the oil contained in the first and second oil supply grooves 61 and 62 may be directly supplied to the compression chamber 42 of the fixed scroll 40.

Figure 15:
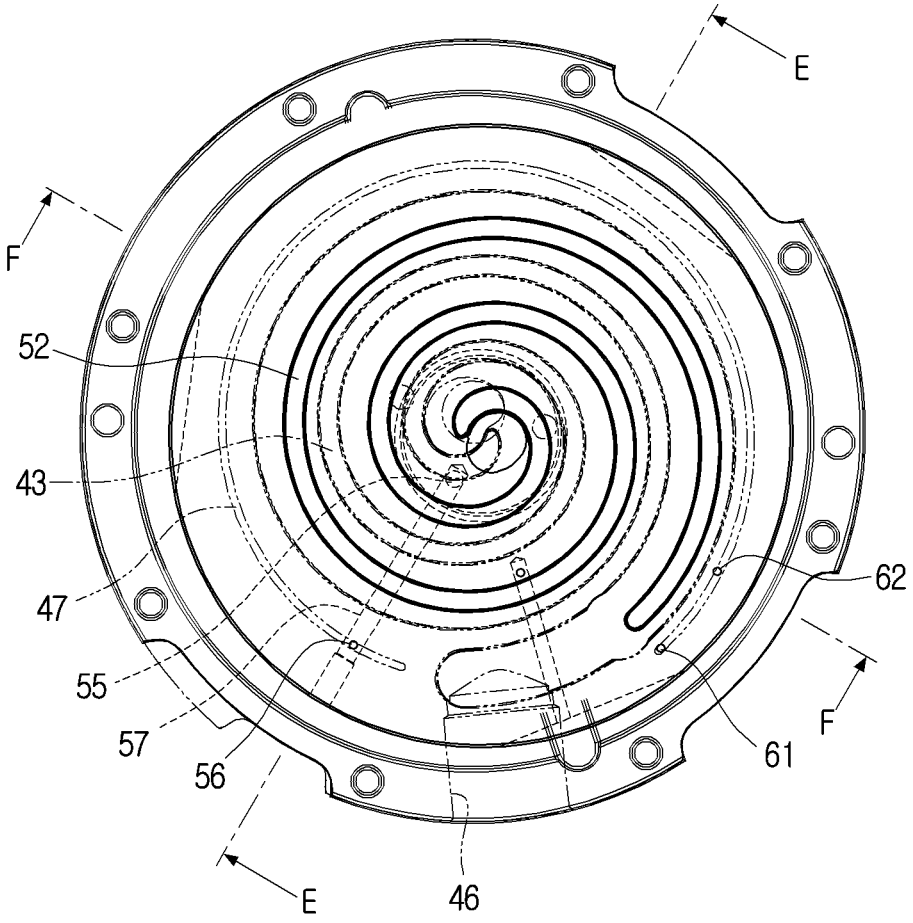
FIG. 15 is a view illustrating a case in which the orbiting scroll is further rotated in the counter-clockwise direction in FIG. 12 so that the oil hole and two oil supply grooves of the orbiting scroll are located below the oil groove of the fixed scroll according to an embodiment of the disclosure.

In the state of FIG. 12, when the orbiting scroll 50 further rotates in the counter-clockwise direction by a predetermined angle, as illustrated in FIG. 15, the oil hole 56 of the orbiting scroll 50 is located below the oil groove 47 of the fixed scroll 40.

Figure 16:
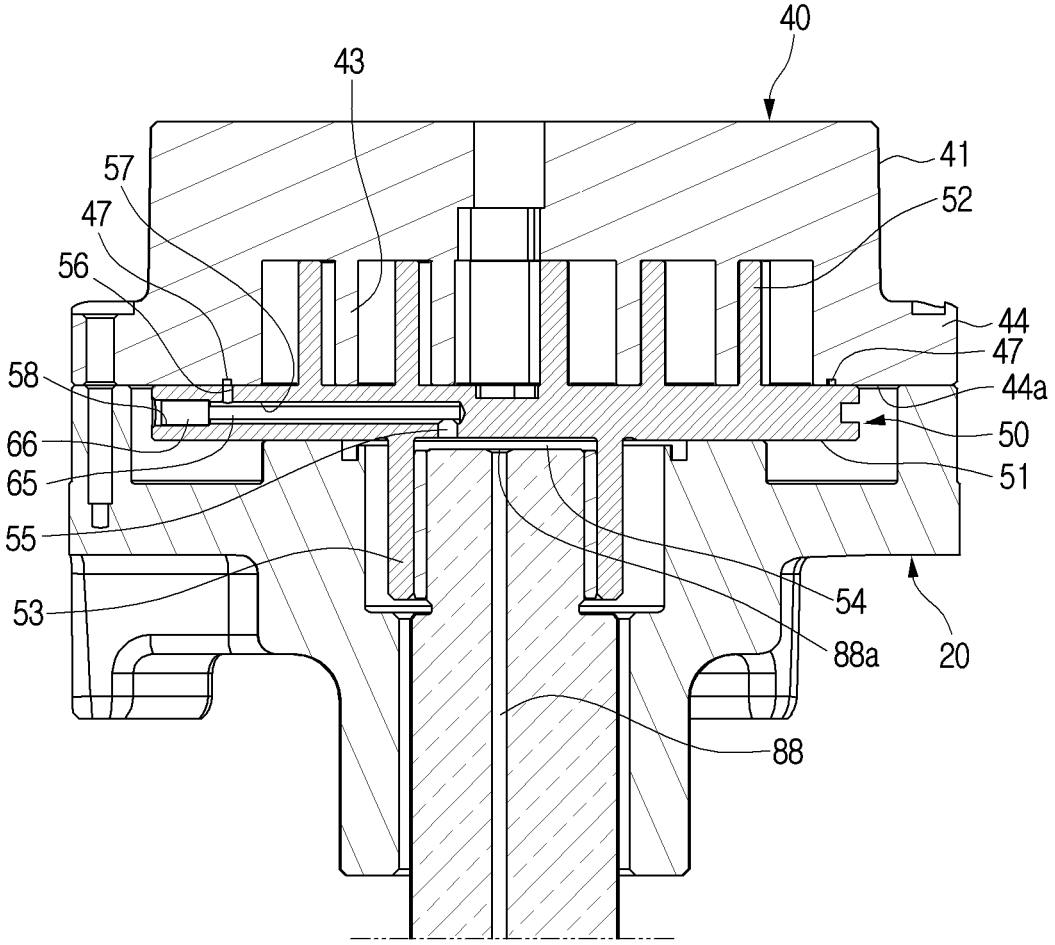
FIG. 16 is a cross-sectional view illustrating the scroll compressor of FIG. 15 taken along line E-E according to an embodiment of the disclosure.
Figure 17:
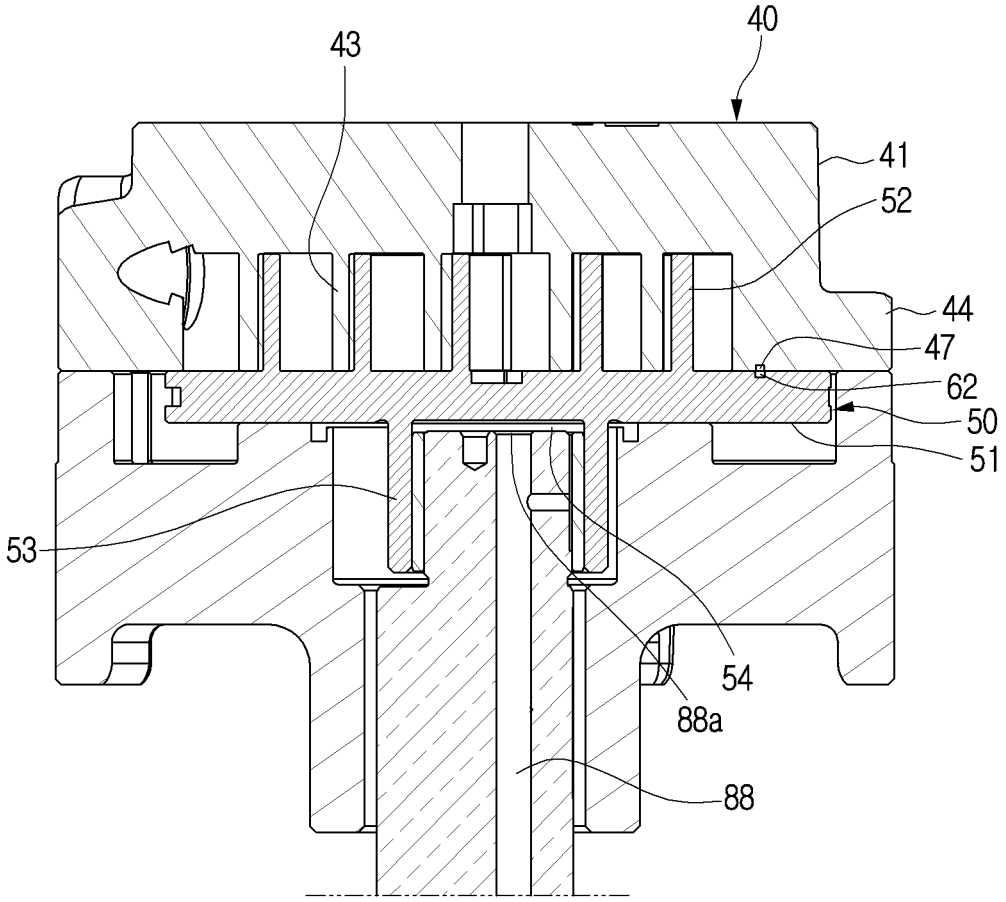
FIG. 17 is a cross-sectional view illustrating the scroll compressor of FIG. 15 taken along line F-F according to an embodiment of the disclosure.

FIG. 15 is a view illustrating a case in which the orbiting scroll is further rotated in the counter-clockwise direction in FIG. 12 so that the oil hole and two oil supply grooves of the orbiting scroll are located below the oil groove of the fixed scroll. FIG. 16 is a cross-sectional view illustrating the scroll compressor of FIG. 15 taken along line E-E. FIG. 17 is a cross-sectional view illustrating the scroll compressor of FIG. 15 taken along line F-F. For reference, in FIG. 15, the fixed scroll 40 is indicated by virtual lines to show the oil hole 56 and the oil supply grooves 61 and 62 of the orbiting scroll 50.

When the orbiting scroll 50 further rotates in the counter-clockwise direction by a predetermined angle, as illustrated in FIGS. 15 and 16, the oil hole 56 of the orbiting scroll 50 is located below the oil groove 47 of the fixed scroll 40, so that the oil hole 56 faces the oil groove 47. In this case, the position of the oil groove 47 of fixed scroll 40 where the oil hole 56 of the orbiting scroll 50 is positioned below the oil groove 47 of the fixed scroll 40 may be referred to as a second position. The second position of the oil groove 47 of the fixed scroll 40 is different from the first position of the oil groove 47 of the fixed scroll 40 described above.

When the oil hole 56 of the orbiting scroll 50 is located at the second position of the oil groove 47 of the fixed scroll 40, the oil hole 56 and the oil groove 47 coincide with each other, so that oil is supplied to the oil groove 47 of the fixed scroll 40 through the oil hole 56.

In detail, the oil in the oil reservoir 15 is supplied to the inner space 54 of the boss portion 53 in which the eccentric portion 87 of the motor shaft 85 is accommodated through the oil passage 88 of the motor shaft 85. The oil in the inner space 54 of the boss portion 53 flows into the oil path 57 through the lower oil hole 55 provided on the lower surface of the mirror plate 51 of the orbiting scroll 50. The oil flowing into the oil path 57 is supplied to the oil groove 47 of the fixed scroll 40 through the oil hole 56 provided on the upper surface of the mirror plate 51.

In addition, referring to FIGS. 15 and 17, when the oil hole 56 of the orbiting scroll 50 is located in the second position of the oil groove 47 of the fixed scroll 40, the two oil supply grooves 61 and 62 of the orbiting scroll 50, that is, the first oil supply groove 61 and the second oil supply groove 62 are located below the oil groove 47 of the fixed scroll 40, so that the first and second oil supply grooves 61 and 62 face the oil groove 47.

When the first and second oil supply grooves 61 and 62 of the orbiting scroll 50 are positioned below the oil groove 47 of the fixed scroll 40, each of the first and second oil supply grooves 61 and 62 coincides with the oil groove 47, so that the oil accommodated in the oil groove 47 of the fixed scroll 40 is supplied to the first and second oil supply grooves 61 and 62.

Figure 18:
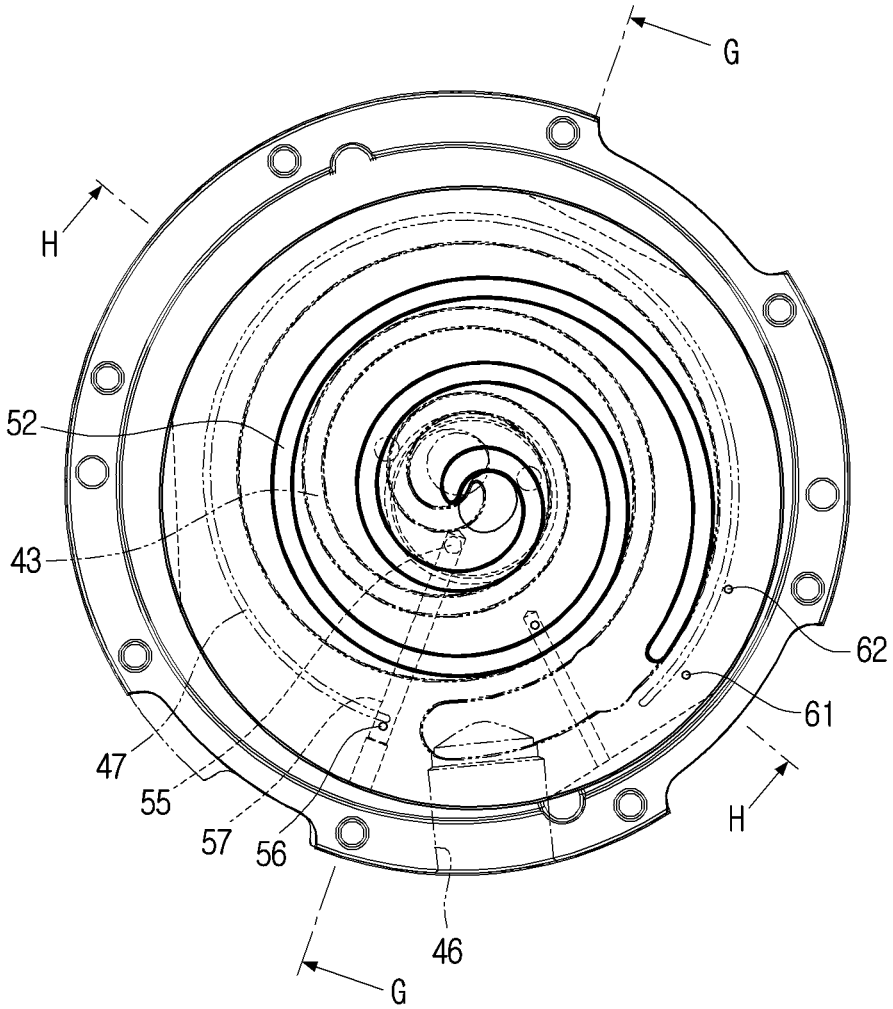
FIG. 18 is a view illustrating a case in which the orbiting scroll is further rotated in the counter-clockwise direction in FIG. 15 so that the oil hole and two oil supply grooves of the orbiting scroll are located outside the oil groove of the fixed scroll according to an embodiment of the disclosure.

In the state of FIG. 15, when the orbiting scroll 50 further rotates in the counter-clockwise direction by a predetermined angle, as illustrated in FIG. 18, the oil hole 56 of the orbiting scroll 50 is out of the oil groove 47 of the fixed scroll 40.

Figure 19:
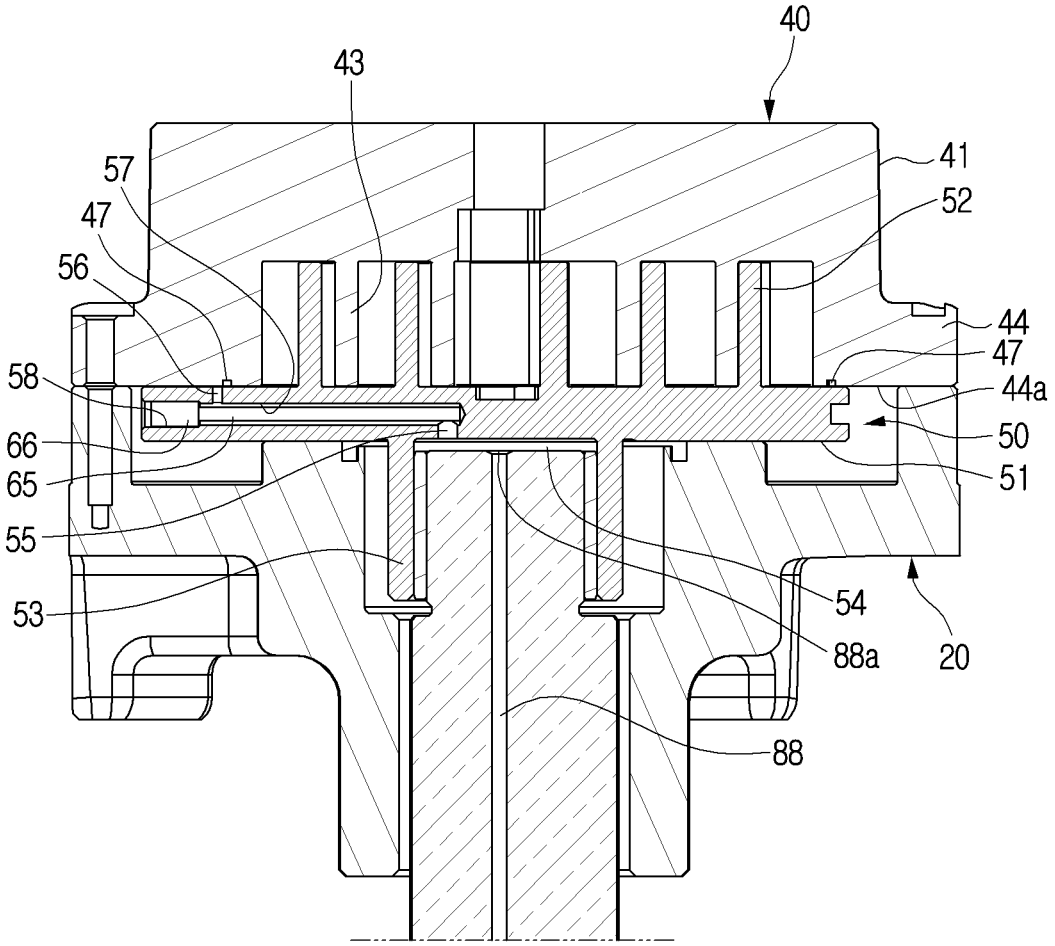
FIG. 19 is a cross-sectional view illustrating the scroll compressor of FIG. 18 taken along line G-G according to an embodiment of the disclosure.
Figure 20:
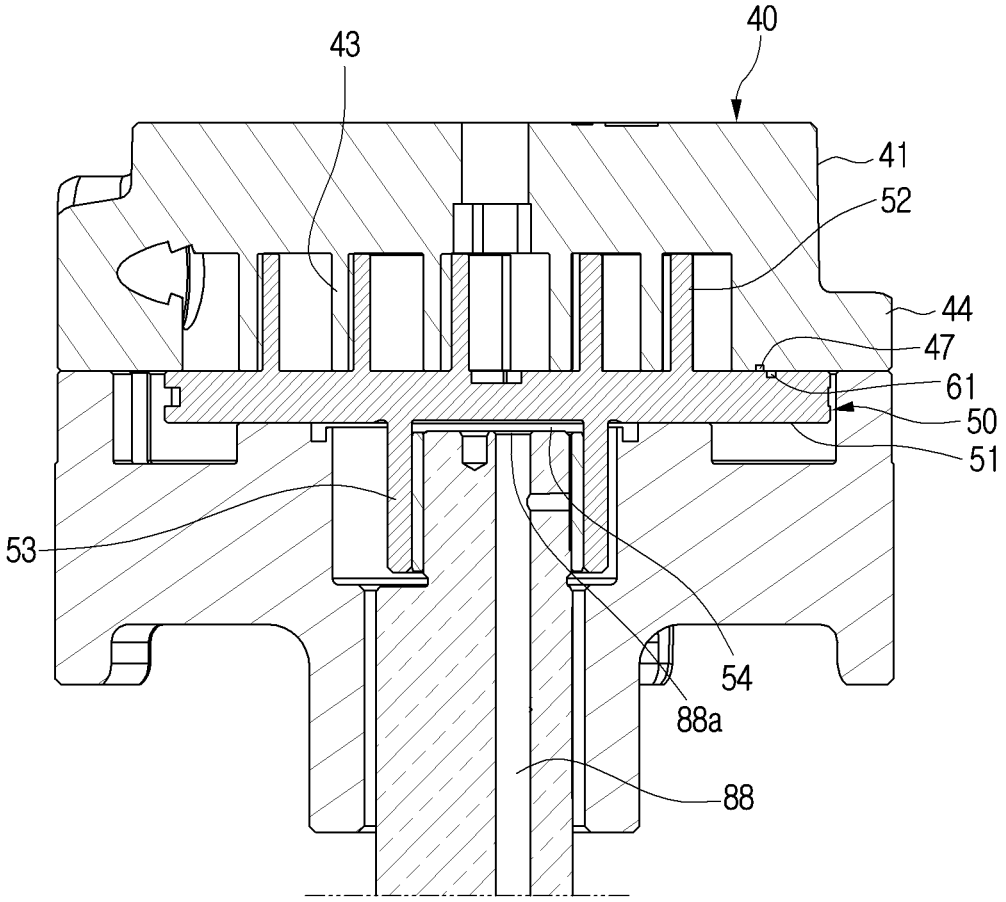
FIG. 20 is a cross-sectional view illustrating the scroll compressor of FIG. 18 taken along line H-H according to an embodiment of the disclosure.

FIG. 18 is a view illustrating a case in which the orbiting scroll further rotates in the counter-clockwise direction in FIG. 15 so that the oil hole and two oil supply grooves of the orbiting scroll are located outside the oil groove of the fixed scroll. FIG. 19 is a cross-sectional view illustrating the scroll compressor of FIG. 18 taken along line G-G. FIG. 20 is a cross-sectional view illustrating the scroll compressor of FIG. 18 taken along line H-H. For reference, in FIG. 18, the fixed scroll 40 is indicated by virtual lines to show the oil hole 56 and the oil supply grooves 61 and 62 of the orbiting scroll 50.

When the orbiting scroll 50 further rotates by a predetermined angle in the counter-clockwise direction, as illustrated in FIGS. 18 and 19, the oil hole 56 of the orbiting scroll 50 gets out of the oil groove 47 of the fixed scroll 40 and is located outside the oil groove 47, that is, close to the outer circumferential surface of the fixed scroll 40. Then, the oil hole 56 of the orbiting scroll 50 faces the thrust surface 44*a* of the fixed scroll 40. Accordingly, the oil hole 56 of the orbiting scroll 50 and the oil groove 47 of the fixed scroll 40 do not coincide with each other.

When the oil hole 56 of the orbiting scroll 50 faces the thrust surface 44*a* of the fixed scroll 40, the oil hole 56 is covered by the thrust surface 44*a*, so that the oil in the oil path 57 is not supplied to the oil groove 47 of the fixed scroll 40.

In addition, referring to FIGS. 18 and 20, when the oil hole 56 of the orbiting scroll 50 is located outside the oil groove 47 of the fixed scroll 40, the first oil supply groove 61 and the second oil supply groove 62 of the orbiting scroll 50 deviate from the oil groove 47 of the fixed scroll 40 and face the thrust surface 44*a* of the fixed scroll 40.

When the first oil supply groove 61 and the second oil supply groove 62 of the orbiting scroll 50 face the thrust surface 44*a* of the fixed scroll 40, the oil received in the first and second oil supply grooves 61 and 62 is not supplied to the compression chamber 42 of the fixed scroll 40.

When the orbiting scroll 50 further rotates in the counter-clockwise direction, as illustrated in FIGS. 9 to 11, the oil hole 56 and two oil supply grooves 61 and 62 of the orbiting scroll 50 may be located below the oil groove 47 of the fixed scroll 40.

As the orbiting scroll 50 rotates, the above-described process is repeated so that the at least one oil supply groove 61 and 62 may supply oil to the compression chamber 42.

As described above, in the scroll compressor 1 according to an embodiment of the disclosure, while the orbiting scroll 50 rotates once, the oil hole 56 of the orbiting scroll 50 meets the oil groove 47 of the fixed scroll 40 twice to supply oil to the oil groove 47.

Figure 21:
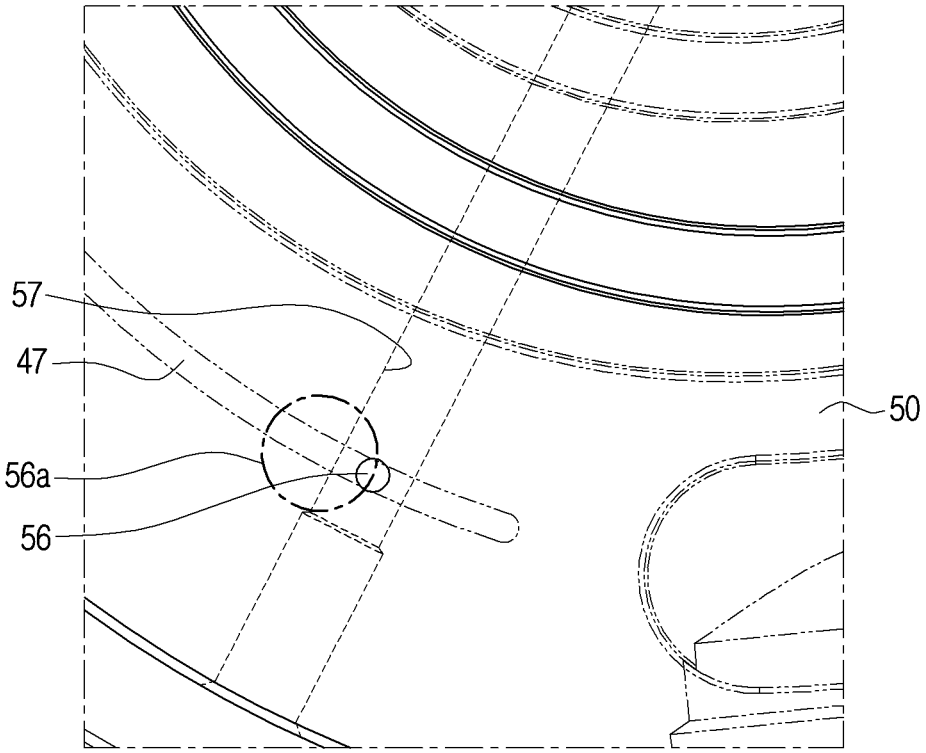
FIG. 21 is a view illustrating movement of an oil hole of an orbiting scroll with respect to an oil groove of a fixed scroll according to rotation of the orbiting scroll according to an embodiment of the disclosure.

In detail, when the orbiting scroll 50 rotates once, the oil hole 56 of the orbiting scroll 50 moves along a circular trajectory 56*a* as illustrated in FIG. 21.

FIG. 21 is a view illustrating movement of an oil hole of an orbiting scroll with respect to an oil groove of a fixed scroll according to rotation of the orbiting scroll.

Referring to FIG. 21, the circle 56*a* indicating the movement trajectory of the oil hole 56 crosses the oil groove 47 twice, while the orbiting scroll 50 rotates once, oil may be supplied to the oil groove 47 of the fixed scroll 40 through the oil hole 56 of the orbiting scroll 50 twice.

In the case of this embodiment, the oil hole 56 is formed to be positioned twice below the oil groove 47 while the orbiting scroll 50 rotates once. However, the disclosure is not limited thereto.

As another example, depending on the amount of oil that needs to be supplied to the oil groove 47 of the fixed scroll 40, the oil hole 56 may be formed so that while the orbiting scroll 50 rotates one time, the oil hole 56 is located below the oil groove 47 once or three times or more.

On the other hand, while the orbiting scroll 50 rotates one time, the two oil supply grooves 61 and 62 of the orbiting scroll 50 are located once in the inner space of the wrap accommodation portion 41 of the fixed scroll 40, that is, the compression chamber 42 to supply oil to the compression chamber 42.

Figure 22:
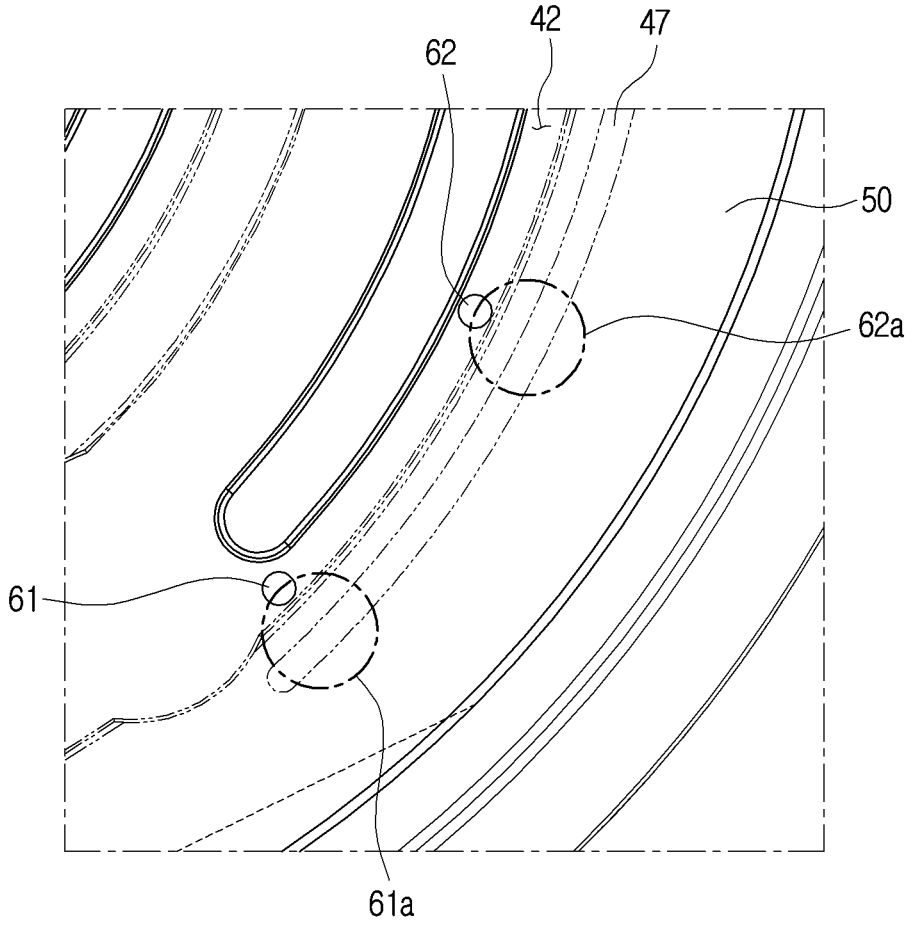
FIG. 22 is a view illustrating movement of two oil supply grooves of an orbiting scroll with respect to an oil groove of a fixed scroll according to rotation of the orbiting scroll according to an embodiment of the disclosure.

In detail, when the orbiting scroll 50 rotates once, the oil supply grooves 61 and 62 of the orbiting scroll 50 move along circular trajectories 61*a* and 62*a* as illustrated in FIG. 22.

FIG. 22 is a view illustrating movement of two oil supply grooves 61 and 62 of an orbiting scroll 50 with respect to an oil groove 47 of a fixed scroll 40 according to rotation of the orbiting scroll 50.

Referring to FIG. 22, parts of the circles 61*a* and 62*a* representing the movement trajectories of the first and second oil supply grooves 61 and 62 are located at the inner area surrounded by the oil groove 47, so that while the orbiting scroll 50 rotates once, the first and second oil supply grooves 61 and 62 may supply oil once to the inner space of the wrap accommodation portion 41 of the fixed scroll 40, that is, to the compression chamber 42.

On the other hand, the two circles 61*a* and 62*a* representing the movement trajectories of the first and second oil supply grooves 61 and 62 of the orbiting scroll 50 cross the oil groove 47 twice, so that while the orbiting scroll 50 rotates once, the oil supply grooves 61 and 62 of the orbiting scroll 50 may be supplied with oil twice from the oil groove 47 of the fixed scroll 40.

In this way, when the oil received in the oil groove 47 of the fixed scroll 40 is directly supplied to the compression chamber 42 using at least one oil supply groove 61 and 62 provided in the orbiting scroll 50, the oil may be effectively supplied to between the tip of the fixed wrap 43 of the fixed scroll 40 and the upper surface of the mirror plate 51 of the orbiting scroll 50 and between the tip of the orbiting wrap 52 of the orbiting scroll 50 and the fixed mirror surface of the fixed scroll 40.

When oil is insufficient between the tip of the fixed wrap 43 of the fixed scroll 40 and the upper surface of the mirror plate 51 of the orbiting scroll 50, friction may occur between the tip of the fixed wrap 43 and the upper surface of the mirror plate 51 of the orbiting scroll 50, resulting in wear due to fusion. In addition, when oil is insufficient between the tip of the orbiting wrap 52 of the orbiting scroll 50 and the fixed mirror surface of the fixed scroll 40, friction may occur between the tip of the orbiting wrap 52 and the fixed mirror surface of the fixed scroll 40, resulting in wear due to fusion.

Figure 23:
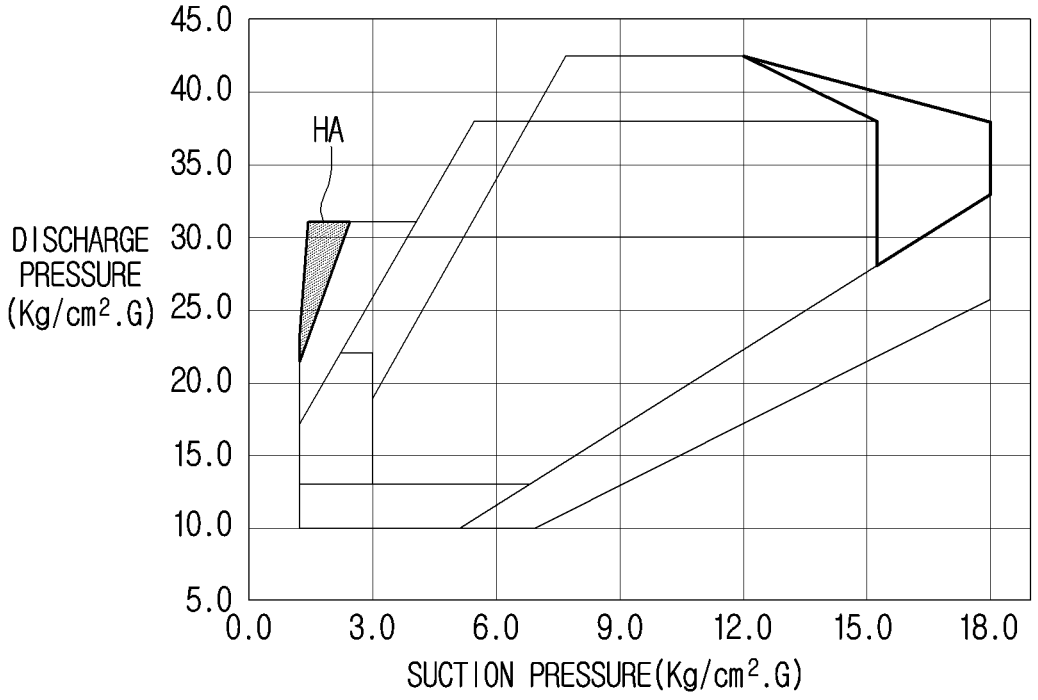
FIG. 23 is a graph illustrating an operating region of a scroll compressor according to an embodiment of the disclosure according to an embodiment of the disclosure.

FIG. 23 is a graph illustrating an operating region of a scroll compressor according to an embodiment of the disclosure.

In FIG. 23, reference symbol HA denotes a high compression ratio region. The compression ratio may be expressed as discharge pressure/suction pressure. The high compression ratio region refers to a range in which the suction pressure is approximately 1 $Kg/cm^2$ to 2.5 $Kg/cm^2$ and the discharge pressure is approximately 22 $Kg/cm^2$ to 31 $Kg/cm^2$.

In the scroll compressor 1, in the high compression ratio region HA, oil viscosity is reduced due to an increase in frictional heat at the tip of the fixed wrap 43 and the tip of the orbiting wrap 52, and the flow rate of the refrigerant is low so that the amount of oil recovered to the compression chamber 42 is insufficient. Therefore, when the scroll compressor according to the prior art operates in the high compression ratio region HA, there is a problem in that the life of the scroll compressor is shortened because friction wear occurs due to friction at the tip of the fixed wrap and the tip of the orbiting wrap.

However, in the scroll compressor 1 according to an embodiment of the disclosure, at least one oil supply groove 61 and 62 provided in the orbiting scroll 50 directly supplies oil to the compression chamber 42 of the fixed scroll 40, so that wear of the tip of the fixed wrap 43 and the tip of the orbiting wrap 52 due to friction may be prevented or reduced. Therefore, the scroll compressor 1 according to an embodiment of the disclosure may stably and reliably operate in the high compression ratio region HA.

In addition, in the scroll compressor 1 according to an embodiment of the disclosure, because at least one oil supply groove is formed on the upper surface of the mirror plate of the orbiting scroll, the processing of the at least one oil supply groove may be convenient.

In addition, in the scroll compressor 1 according to an embodiment of the disclosure, because at least one oil supply groove provided on the upper surface of the mirror plate of the orbiting scroll does not penetrate fully through the mirror plate, oil may be constantly supplied to the compression chamber without being affected by pressure changes below the mirror plate.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A scroll compressor comprising:

a fixed scroll including:

a wrap accommodation portion having an inner space extending inside the wrap accommodation portion, a thrust surface formed around the inner space, a fixed wrap extending downward into the inner space, and an oil groove formed on the thrust surface;

an orbiting scroll configured below the fixed scroll and to rotate with respect to the fixed scroll, the orbiting scroll including:

a mirror plate, an orbiting wrap extending from an upper surface of the mirror plate so as to engage with the fixed wrap of the fixed scroll, at least one oil supply groove on the upper surface of the mirror plate so as to face the thrust surface of the fixed scroll, and a first oil hole configured on the upper surface of the mirror plate to supply oil to the oil groove of the fixed scroll; and a driving motor configured to rotate the orbiting scroll, wherein the orbiting scroll is configured so that:

when the orbiting scroll rotates, the at least one oil supply groove of the orbiting scroll moves from a first position to receive oil from the oil groove of the fixed scroll to a second position to supply the oil to the inner space of the wrap accommodation portion of the fixed scroll, and the first oil hole cyclically crosses the oil groove of the fixed scroll.

2. The scroll compressor of claim 1, wherein the at least one oil supply groove of the orbiting scroll is configured so that when the orbiting scroll rotates once, the at least one oil supply groove of the orbiting scroll faces the oil groove of the fixed scroll at least once in the first position, and faces the inner space of the wrap accommodation portion of the fixed scroll in the second position.

3. The scroll compressor of claim 1, wherein the at least one oil supply groove of the orbiting scroll is formed so as not to penetrate through to a bottom surface of the mirror plate.

4. The scroll compressor of claim 1, wherein
the at least one oil supply groove of the orbiting scroll is formed adjacent to an outer end of the orbiting wrap.

5. The scroll compressor of claim 1, wherein
the wrap accommodation portion of the fixed scroll includes a suction portion through which refrigerant is sucked into the inner space, and
the oil groove of the fixed scroll is formed to surround an entire circumference of the inner space except for the suction portion.

6. The scroll compressor of claim 1, wherein
the first oil hole is formed to face the oil groove of the fixed scroll at least once when the orbiting scroll rotates one time.

7. The scroll compressor of claim 1, wherein the orbiting scroll further includes:
a boss portion extending downward from a lower surface of the mirror plate,
wherein the first oil hole is formed to communicate with an inner space of the boss portion.

8. The scroll compressor of claim 7, wherein
the orbiting scroll further includes:
a second oil hole formed on the lower surface of the mirror plate to face the inner space of the boss portion; and
an oil path formed inside the mirror plate of the orbiting scroll so as to connect the second oil hole and the first oil hole.

9. The scroll compressor of claim 8, wherein
the oil path is formed so as to extend from an outer circumferential surface of the mirror plate toward a center of the mirror plate to meet the first oil hole and the second oil hole.

10. The scroll compressor of claim 9, wherein
the orbiting scroll further includes an orifice pin disposed in the oil path.

11. The scroll compressor of claim 7, further comprising:
a casing,
wherein the driving motor includes:
a stator fixed to the casing;
a rotor positioned inside the stator;
a motor shaft fixed to a center of the rotor and having a first end coupled to the boss portion of the orbiting scroll; and
an oil passage formed in a longitudinal direction inside the motor shaft,
wherein the oil is accommodated in a lower portion of the casing, and
the oil is supplied to the inner space of the boss portion of the orbiting scroll through the oil passage of the motor shaft.

12. The scroll compressor of claim 1, wherein
the first oil hole is spaced apart at a predetermined angle from the at least one oil supply groove of the orbiting scroll.

13. The scroll compressor of claim 12, wherein
the first oil hole and the at least one oil supply groove of the orbiting scroll are spaced apart from each other so that the first oil hole is adjacent to a first end of the oil groove of the fixed scroll, and
the at least one oil supply groove of the orbiting scroll is adjacent to a second end of the oil groove of the fixed scroll.

14. The scroll compressor of claim 1, wherein
when the first oil hole faces the oil groove of the fixed scroll, the at least one oil supply groove of the orbiting scroll faces the oil groove of the fixed scroll.

* * * * *